US006226935B1

(12) United States Patent
Kuramochi et al.

(10) Patent No.: US 6,226,935 B1
(45) Date of Patent: May 8, 2001

(54) SEISMIC ISOLATOR

(75) Inventors: Michio Kuramochi, Tokorozawa; Teiji Kojima; Ryosuke Narita, both of Tokyo; Haruo Kuramochi, Kawaguchi; Naomi Kitayama, Fussa; Takashi Toriya, Asaka, all of (JP)

(73) Assignees: NEC System Integration & Construction, Ltd.; DPC Bridge Works, Co., Ltd., both of Tokyo (JP)

( * ) Notice: Subject to any disclaimer, the term of this patent is extended or adjusted under 35 U.S.C. 154(b) by 0 days.

(21) Appl. No.: 09/452,630

(22) Filed: Dec. 1, 1999

(30) Foreign Application Priority Data

Dec. 10, 1998 (JP) ..... 10-351140
Jul. 13, 1999 (JP) ..... 11-198782

(51) Int. Cl.[7] ..... E04B 1/98
(52) U.S. Cl. ..... 52/167.4; 52/167.1; 52/167.3
(58) Field of Search ..... 52/167.4, 167.1, 52/167.3, 167.6

(56) References Cited

U.S. PATENT DOCUMENTS 3,283,515 * 11/1966 Pottorf ..... 61/46
5,775,038 * 7/1998 Sauvageot ..... 52/167.8
5,881,507 * 3/1999 Yoo et al. ..... 52/167.8

FOREIGN PATENT DOCUMENTS

54/16330 6/1979 (JP) ..... E04B/1/36
54/40842 12/1979 (JP) ..... E04B/1/36
63/574 1/1988 (JP) ..... E04B/1/36
63/21780 5/1988 (JP) ..... E04B/1/36

* cited by examiner

*Primary Examiner*—Carl D. Friedman
*Assistant Examiner*—Patrick J. Chavez
(74) *Attorney, Agent, or Firm*—Pearne & Gordon LLP

(57) ABSTRACT

A seismic isolator wherein vibrating units 5 arranged in a multiplex manner are formed of suspension members 53 constituting tensile force bearing members, and frames 51 and bases 52 to which both end portions of the suspension members are joined, adjacent vibrating units 5, 5 being joined together by diagonal members 6 of wire rods constituting compressive force bearing members, whereby the area occupied by the seismic isolator decreases.

3 Claims, 28 Drawing Sheets

SEISMIC ISOLATOR

BACKGROUND OF THE INVENTION

1. Field of the Invention

This invention relates to a seismic isolator which comprises vibrating units arranged in a multiplexed manner around a core member suspended from an upper structure, and which is adapted to cut off horizontal vibration of a lower structure.

2. Description of the Related Art

A seismic isolator which comprises a core member suspended from an upper structure, and vibrating units arranged in a multiplexed manner around the core member, and which is adapted to cut of f horizontal vibration of a lower structure, as disclosed in Japanese Patent Publication Nos. 16330/1979, 40842/1979, 574/1988 and 21780/1988 is characterized in that a plurality of frustoconical vibrating units of different scales are arranged in a multiplexed manner with adjacent vibrating units combined with one another by suspension members, a vertical load of the upper structure being borne as a compressive force by the core member and vibrating units, and as a tensile force by suspension members provided among the vibrating units, whereby the upper structure is substantially supported in a suspended state on the lower structure.

Owing to a plurality of vibrating units arranged in a multiplexed manner, a pendulum length larger than a distance between the upper and lower structures is secured. Since a vibration cycle corresponding to the pendulum length equal to the sum of a total length of all of the suspension members is given to the upper structure, the vibration cycle of the upper structure increases to a high level to cut off horizontal vibration of the lower structure.

The vibrating units are formed cylindrically, and the compressive force bearing portions of the vibrating units are formed of face bars. Therefore, in order that the vibrating units positioned relatively on the outer circumferential side support the inner circumferential side vibration units without hindering the relative displacement of the latter vibration units, it is necessary that the vibrating units on the outer circumferential side be larger than those on the inner circumferential side. Therefore, it is necessary that the radius of the vibrating units positioned on the outermost circumferential side be so large that corresponds to the sum of the amplitude of vibrating units, and the area occupied by a seismic isolator generally tends to increase.

SUMMARY OF THE INVENTION

The present invention has been achieved by developing the above-described seismic isolator, and proposes a seismic isolator of the type which does not cause an increase in the area occupied thereby, and a seismic isolator of the same construction to which a function of absorbing a seismic impact force is added.

In the previously-described seismic isolator, compressive force bearing portions constitute vibrating units, and adjacent vibrating units are combined with one another by suspension members constituting tensile force bearing members. According to the present invention, vibration units are formed of suspension members constituting tensile force bearing members, and frames and bases to which both end portions of the suspension members are joined, and adjacent vibrating units are joined together by compressive force bearing members, which comprises wire rods, whereby the necessity of increasing the area of lower end portions of the vibrating units is eliminated to reduce the area occupied by the seismic isolator comprising vibrating units arranged in a multiplexed manner.

The seismic isolator comprises a core member bearing a vertical load of the upper structure as a compressive force, and a plurality of vibrating units arranged in a multiplexed manner around the core member, the vibrating units comprising frames positioned on a relatively upper side, bases positioned below the frames, and suspension members provided between the frames and bases, supporting the bases in a suspending state and bearing the vertical load of the upper structure as a tensile force.

The vibrating units positioned on the relatively inner circumferential side are supported on the vibrating units positioned on the outer circumferential side thereof via diagonal members constituting compressive force bearing members. The diagonal members are provided between the frames of the vibrating units positioned on the relatively inner circumferential side and the bases of the vibrating units positioned on the outer circumferential side, bear the vertical load of the upper structure as a compressive force, and support the inner circumferential side vibrating units on the outer circumferential side vibrating units.

A lower end portion of the core member is joined to the bases of the vibrating units positioned on the innermost circumferential side, and the vibrating units positioned on the outermost circumferential side are supported on the lower structure directly via the diagonal members provided between the relative frames and the lower structure, or on the lower structure via the diagonal members and the relative bases.

The core member extends through the frames of all of the vibration units, and is relatively displaced with respect to the frames when the upper and lower structures are relatively displaced with respect to each other, so that the frames are formed so as to have holes which do not hinder the relative displacement of the core member.

The vertical load of the upper structure is transmitted from the core member to the bases joined thereto, and the vertical load transmitted to these bases to the relative frames on the upper side via the suspension members. The resultant load is further transmitted to the bases of the outer circumferential side vibrating units, which support these frames, via the relative diagonal members, and finally from the frames of the vibrating units positioned on the outermost circumferential side to the lower structure via the relative diagonal members or via the relative diagonal members and bases.

The upper structure is virtually put in a condition in which it is supported in a suspended state on the lower structure via a suspension member the length of which corresponds to the sum of a total length of all of the suspension members, and a vibration cycle corresponding to a pendulum length equal to the sum of a total length of all of the suspension members is given to the upper structure to increase the cycle thereof to a high level, and cut off the horizontal vibration of the lower structure.

When the upper structure is relatively displaced with respect to the lower structure due to the vibration of the latter structure, the bases of the vibrating units on the innermost circumferential side to which the core member is joined are relatively displaced with the upper structure with respect to the relative frames on the upper side, while the frames of the vibrating units on the innermost circumferential side and the bases of the vibrating units on the outer circumferential side joined thereto via the relative diagonal members are relatively displaced with respect to the relative frames on the upper side. In the whole of the seismic isolator, relative displacement corresponding to the sum of amounts of relative displacement of the bases of all vibrating units occurring with respect to the frames on the upper side occurs between the upper and lower structures.

When the bases of the vibrating units are relatively displaced with respect to the frames at the time of occurrence of vibration of the lower structure with the shapes and sizes in plan of adjacent vibrating units identical with each other, the bases cannot collide with compressive force bearing members to be displaced, when the compressive force bearing members are face bars. According to the present invention, the diagonal members constituting compressive force bearing members are wire rods. Therefore, when the direction of adjacent vibrating units is regulated, hollow spaces allowing the displacement of the bases occurs around therearound, so that the bases can be relatively displaced with respect to the frames even when the shapes and sizes of adjacent vibrating units are identical with each other.

For example, when as defined in claim 2 the shape in plan of the vibrating units, i.e. the shapes in plan of the frames and bases are polygonal with adjacent vibrating units arranged in a non-overlapping manner in plan and the diagonal members extending between corner portions of the frames and those of the bases, spaces in which the bases of the vibrating units on the inner circumferential side can be relatively displaced with respect to those of the vibrating units on the outer circumferential side are formed in the portions other than those in which the diagonal members are provided, even when the frames and bases have the same shape and same sizes. Accordingly, the bases of the vibrating units positioned on the relatively outer circumferential side are not necessarily larger than those of the vibrating units positioned on the inner circumferential side.

To describe the matter more exactly, when both the frames and bases are equilaterally triangular, the bases of the vibrating units positioned on the relatively inner circumferential side and those of the vibrating units positioned on the outer circumferential side are arranged in a point symmetric manner. Consequently, the relatively inner circumferential side bases can be relatively displaced with respect to the outer circumferential side bases until the core member has collided with an inner circumference of any frame, or until side portions of the inner circumferential side bases have collided with diagonal members passing apexes of the outer circumferential side bases even when these bases on two sides have the same sizes. Therefore, the bases of the outer circumferential side vibrating units may not be larger than those of the inner circumferential side vibrating units.

Both the frames and bases may be circular. When the portions to which the suspension members are joined are formed so as to project around the frames and bases, the frames and bases are virtually polygonal concerning the provision of the diagonal members, so that the basic shape of the frames and bases may not be polygonal. Namely, the shape in plan of the frames and bases is not specially limited.

In a conventional multiplexed type seismic isolator, the vibrating units positioned on the relatively inner circumferential side are supported on the suspension members of the vibrating units positioned on the outer circumferential side as described above, so that, when the lower structure is vibrated, the vibrating units are vibrated separately. Therefore, in order to avoid the collision of adjacent vibrating units with each other, the vibrating units on the outer circumferential side are necessarily larger than those on the inner circumferential side.

According to the present invention, the inner and outer circumferential side vibrating units are arranged with the bases of the same shape and sizes faced in different directions, so that the diagonal members can be provided between the bases of the outer circumferential side vibrating units and the frames of the inner circumferential side vibrating units in order to avoid the collision of the diagonal members with the base of the inner circumferential side vibrating units. This causes the necessity of making the outer circumferential side vibrating units larger than the inner circumferential side vibrating units to be taken away.

Consequently, increasing the scale of the vibrating units from the inner circumferential side toward the outer circumferential side becomes unnecessary, and the reduction of the area occupied by the seismic isolator comprising vibrating units arranged in a multiplexed manner becomes possible.

Since the compressive force bearing members comprise the diagonal members, the construction of the vibrating units is simplified as compared with that of the vibrating units using face bars as the compressive force bearing members. Moreover, the weight of the vibrating units themselves decreases, so that the reduction of the manufacturing cost and the improvement of the efficiency of assembling work can be attained.

Since the compressive force bearing members comprise wire rods, the constituent members as a whole of the vibrating units can be seen through, and this enables the maintenance and management of the vibrating units to be carried out easily. When springs for cutting off the relative vertical displacement of the upper and lower structures are provided at the joint portions of the suspension members and frames and bases, or when dampers for suppressing the vertical vibration thereof are provided, the suspension members are not hidden behind the compressive force bearing members. Therefore, the installing and removing of the springs or dampers and the maintenance and management thereof can be carried out easily.

In the invention defined in claim 3, an impact force absorbing function is added to the seismic isolator by providing on end portions or intermediate portions of the diagonal members with impact absorption members capable of being expanded and contracted freely in the axial direction of the diagonal members and having a compressive force bearing capability and a restoring force.

An impact force at a first arrival of an earthquake motion is inputted from the lower structure into the vibration units on the outermost circumferential side. Therefore, in order to cut off the transmission of the impact force to the vibrating units, it is rational to provide impact absorption members on the diagonal members extended between the frames of the vibrating units positioned on the outermost circumferential side and the lower structure or the bases. The impact absorption members are also provided additionally on the diagonal members on the inner side of the mentioned diagonal members.

The impact absorption members provided on parts of the diagonal members joined to the vibrating units positioned on the outermost circumferential side contract or expand due to a vertical or horizontal impact force inputted into the lower structure due to an earthquake motion and transmitted therefrom to the diagonal members directly or via the bases. Owing to such expansion and contraction of the impact absorption members, the transmission of the impact force to the frames to which upper end portions of the diagonal members are joined is cut off or lessened to maintain the performance of the seismic isolator in a sound condition. After the impact absorption members have contracted, they return to their original shapes owing to the restoring force thereof.

Since the transmission of the impact force to the frames to which the upper end portions of the diagonal members are joined is cut off or lessened, the transmission of the impact force to the vibrating units positioned on the inner side of the outermost circumferential side vibrating units is cut off, and the upper structure which the seismic isolator supports is also maintained in a sound condition.

The impact absorption members comprise various types of axially expansible and contractible springs and rubber members as well as members of rubber of a high damping ratio obtained by mixing carbon in a raw rubber material. Shocking vibration is damped by a frictional force occurring in springs during the deformation thereof when the impact absorption members comprise springs, and by a damping force occurring during the deformation of rubber when the impact absorption members comprise rubber of a high damping ratio.

DESCRIPTION OF THE PREFERRED EMBODIMENT

Figure 1:
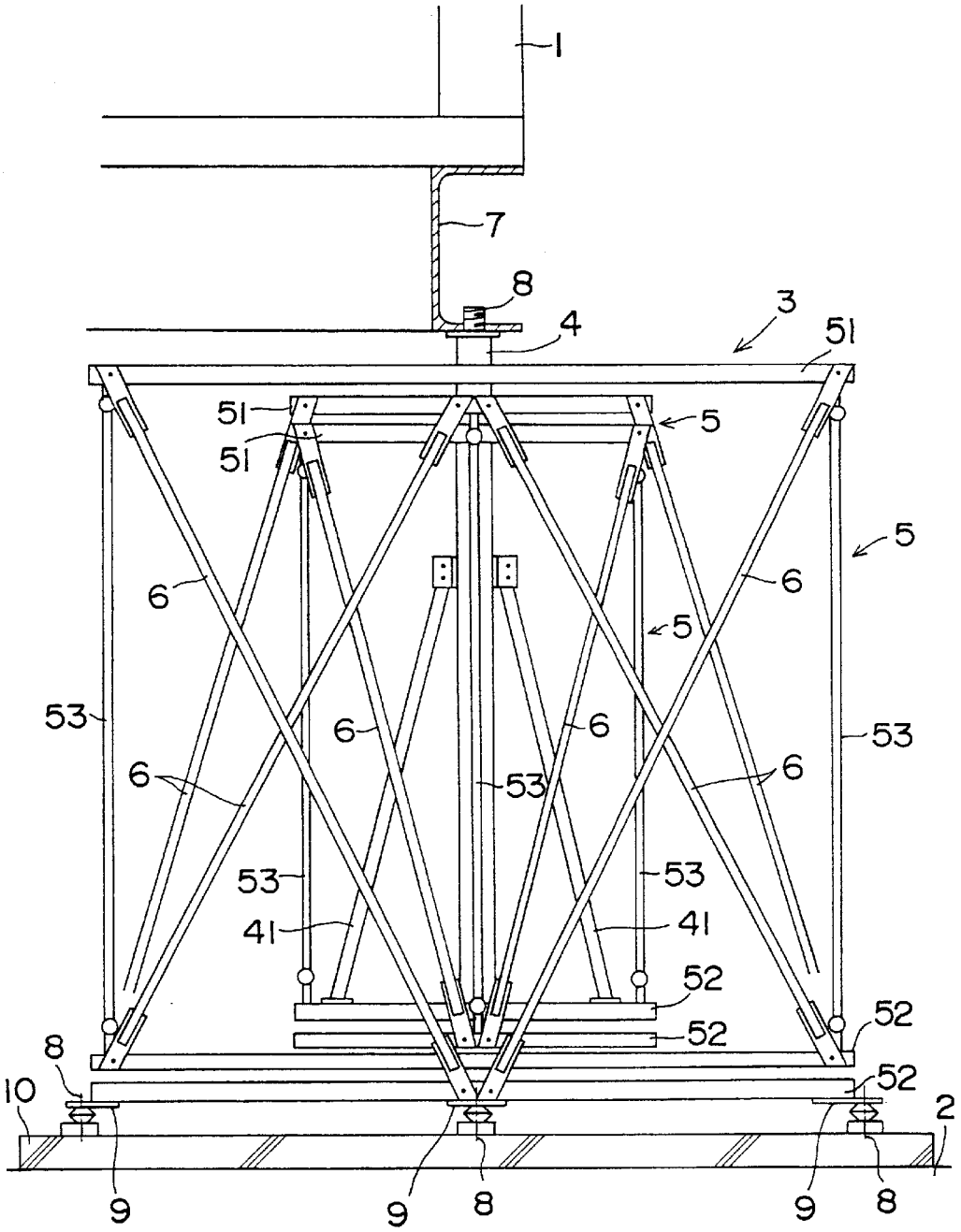
FIG. 1 is an elevational view showing an example of the construction and installation of a seismic isolator.
Figure 2:
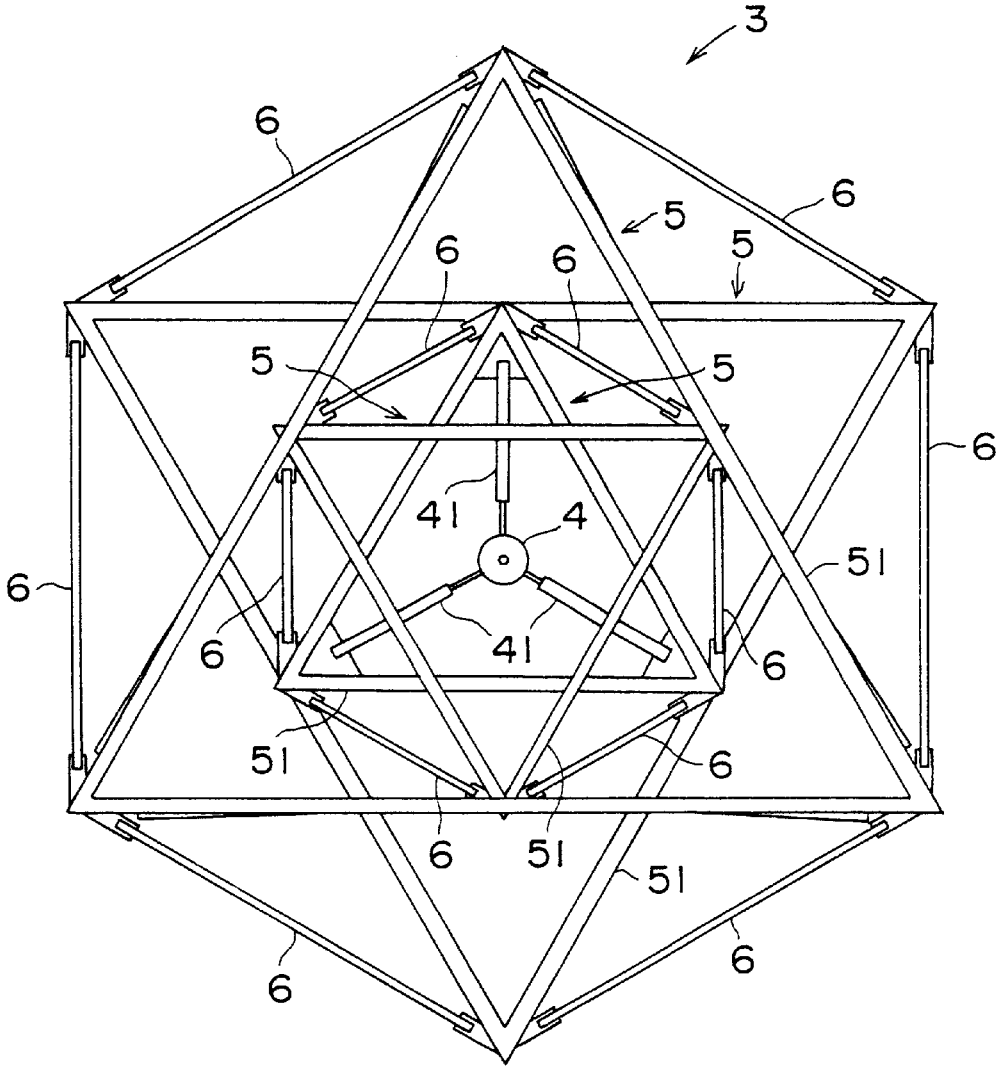
FIG. 2 is a plan view of what is shown in FIG. 1.

As shown in FIGS. 1 and 2, a seismic isolator 3 according to the present invention comprises a core member 4 joined to an upper structure 1, insulated from a lower structure 2 and normally bearing a vertical load of the upper structure 1 as a compressive force, and a plurality of vibrating units 5 arranged in a multiplexed manner around the outer circumference of the core member 4 and adapted to generate vibration when the lower structure 2 is vibrated.

Figure 8:
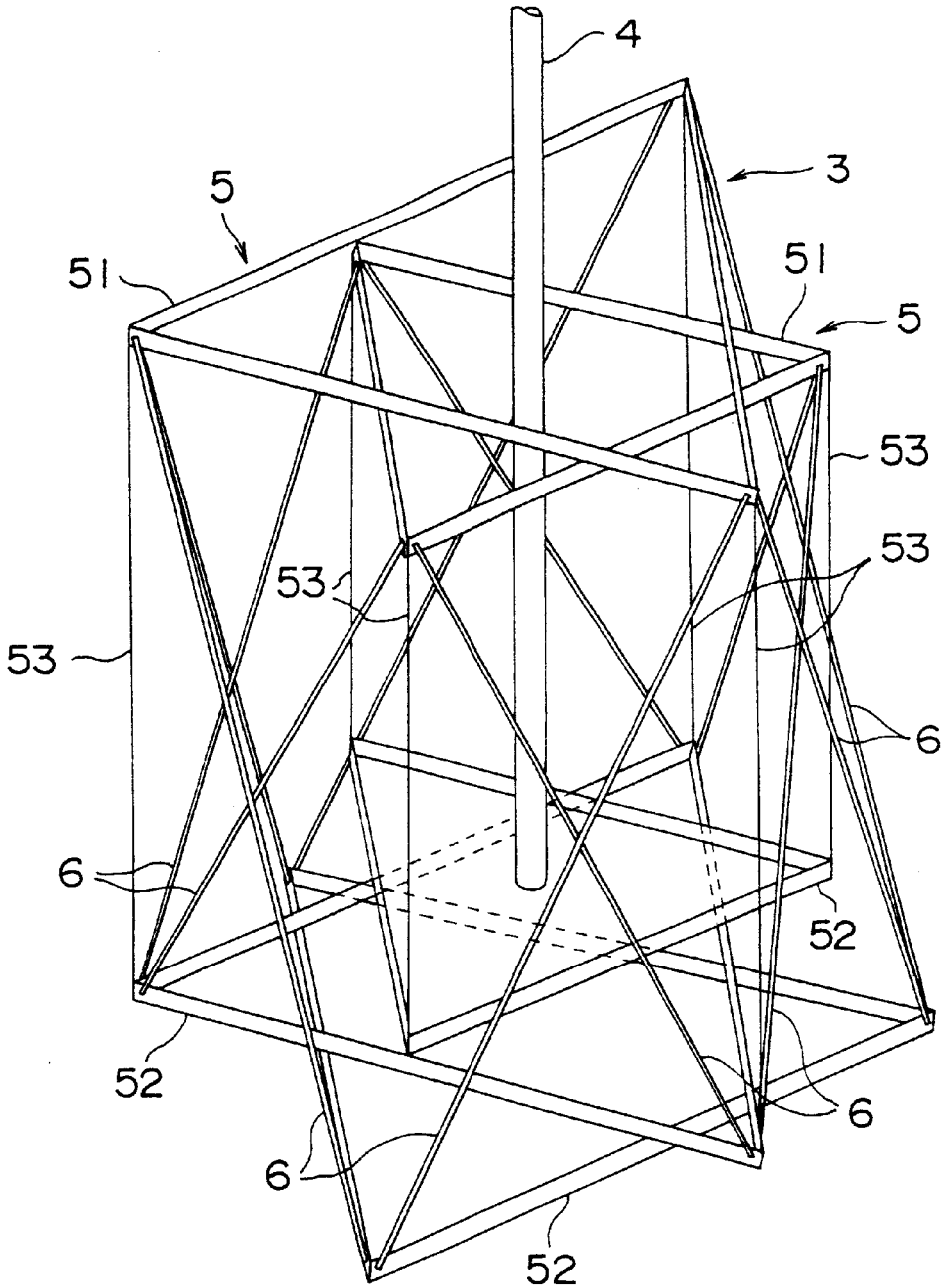
FIG. 8 is a perspective view showing the seismic isolator of a simplified construction of FIG. 1.

As shown in FIG. 8, in which the seismic isolator 3 of FIGS. 1 and 2 is shown in a simplified manner, the vibrating units 5 comprise frames 51 positioned on the relatively upper side, bases 52 positioned below the frames 51, and suspension members 53 provided between the frames 51 and bases 52, supporting the bases 52 in a suspended state on the frames 51, and normally bearing a vertical load of the upper structure 1 as a tensile force.

The plural vibrating units 5 are combined with one another so that the frames 51 of the vibrating units 5 positioned on the relatively outer circumferential side are placed on those 51 of the vibrating units 5 positioned on the inner circumferential side with the bases 52 of the vibrating units 5 positioned on the outer circumferential side placed on the underside of those 52 of the vibrating units 5 positioned on the inner circumferential side.

When the frames 51 and bases 52 are polygonal, the frames 51, 51 and bases 52, 52 respectively of diametrically adjacent vibrating units 5, 5 are arranged so as not to overlap each other in plan as shown in FIG. 2. When the frames 51 and bases 52 are circular as will be described later, gusset plates to which suspension members are to be joined are arranged so as not to overlap each other.

Between the frames 51 of the vibrating units 5 positioned on the relatively inner circumferential side and the bases 52 of the vibrating units 5 positioned on the outer circumferential side, and, between the frames 51 of the vibrating units 5 positioned on the outermost circumferential side and the lower structure 2, diagonal members 6 bearing a vertical load of the upper structure 1 as a compressive force are provided.

Owing to the diagonal members 6, the inner circumferential side vibrating units 5 are supported on their outer circumferential side vibrating units 5, and the outermost circumferential side vibrating units 5 on the lower structure 2. In the illustrated seismic isolator, the lower end portions of the diagonal members 6 provided on the outermost circumferential side are joined to the bases 52, and the bases 52 to the lower structure 2 but the lower end portions of the diagonal members 6 are joined directly to the lower structure 2 in some cases.

FIGS. 1 and 2 show a seismic isolator in which base plates 9 a re fixed to corner portions of the bases 52 of the vibrating units 5 positioned on the outermost circumferential side, and fastened to a footing 10 of the lower structure 2 by bolts 8 to thereby combine the bases 52 with the lower structure 2. As long as such a combined condition can be retained when the upper and lower structures 1, 2 are relatively displaced, the method of combining the bases 52 and footing 10 with each other or the diagonal members 6 and footing 10 with each other is not specially limited.

A vertical load of the upper structure 1 is transmitted from the core member 4 to the bases 52 of the innermost circumferential side vibrating units 5, and then to the frames 51, which are positioned above these bases 52, via the tensile force bearing suspension members 4. The load is further transmitted from the frames 51 to the bases 52 of the vibrating units 5 positioned on the outer circumferential side, via the compressive force bearing diagonal members 6, and finally from the bases 52 of the outermost circumferential side vibrating units 5 or from the diagonal members 6 provided between the frames 51 of the outermost circumferential side vibrating units 5 and the lower structure 2 to the lower structure 2.

The diagonal members 6 are disposed so as to form trusses with parts of the frames 51 of the vibrating units 5 positioned on the relatively inner circumferential side and those of the bases 52 of the vibrating units 5 positioned on the outer circumferential side, and the frames 51 of the inner circumferential side vibrating units 5 and the bases 52 of the outer circumferential side vibrating units 5 are joined to each other by the diagonal members 6, whereby the vibrating units 5 behave together when the lower structure 2 is vibrated.

Figure 3:
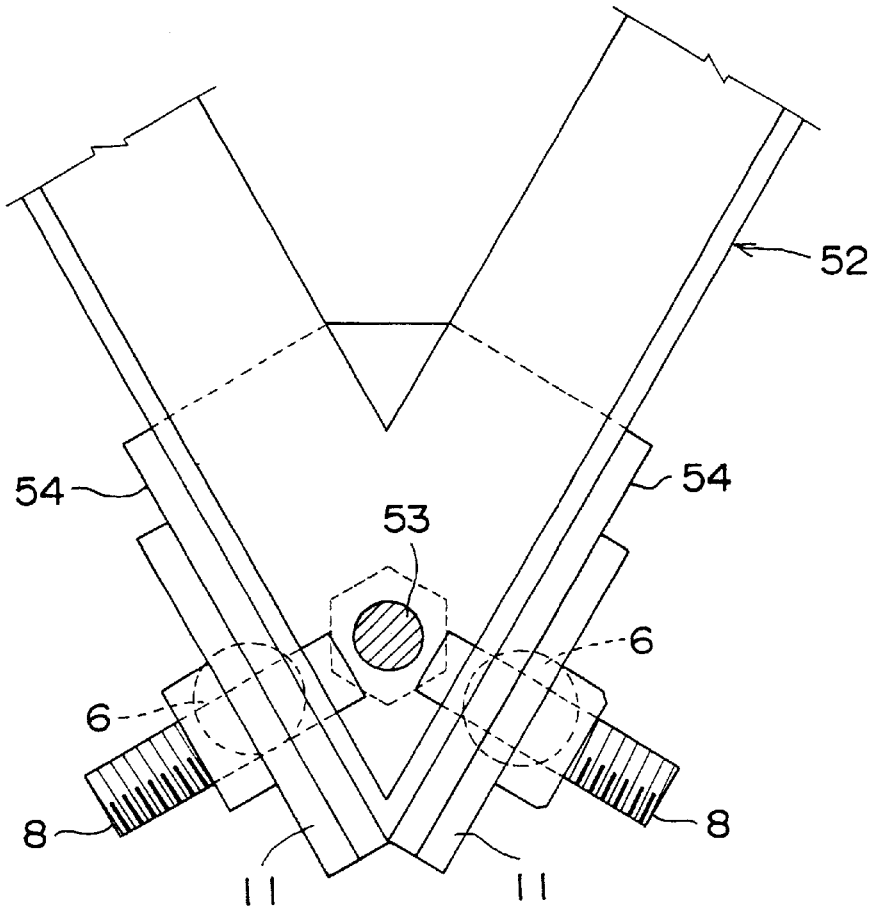
FIG. 3 is a plan view showing the tie-in of diagonal members and bases.
Figure 4:
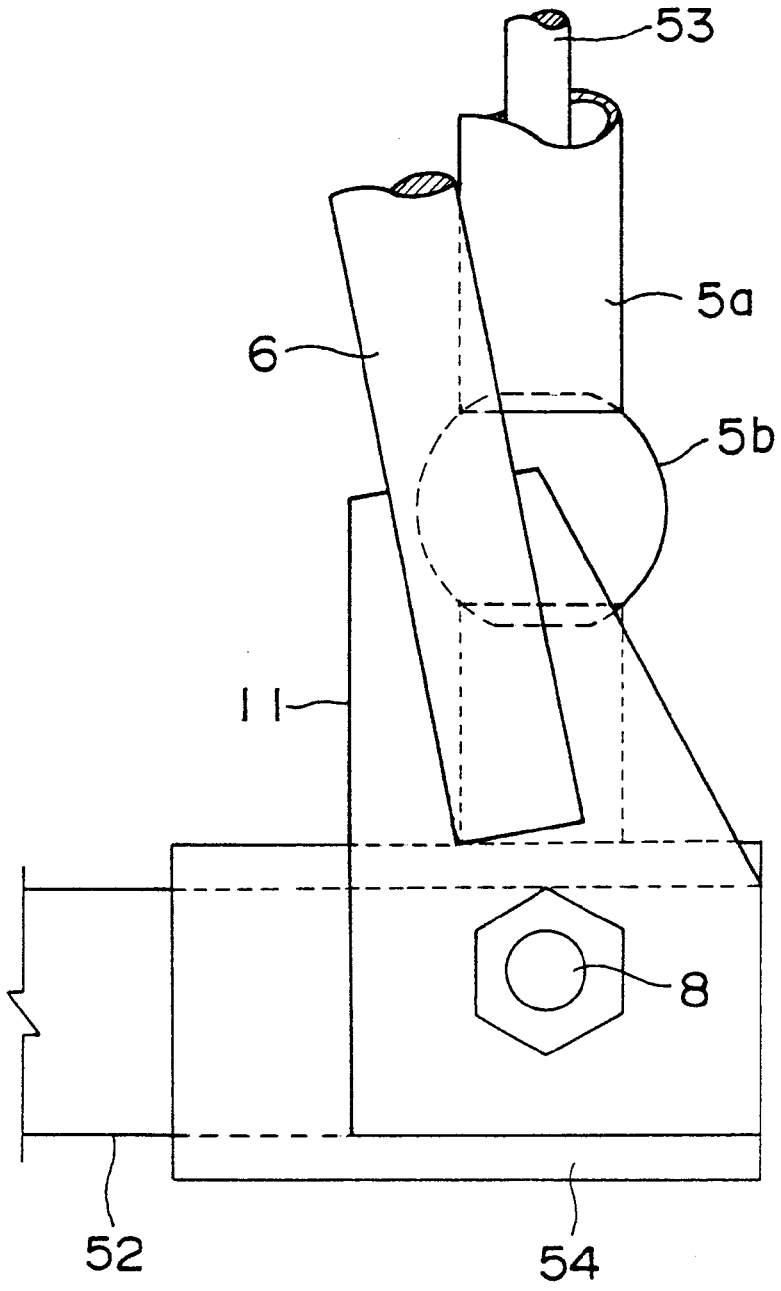
FIG. 4 is an elevational view of what is shown in FIG. 3.

When the frames 51 and bases 52 are polygonal, the diagonal members 6 are disposed between the apexes thereof, and both end portions of the diagonal members are joined to gusset plates 11 fixed to side surfaces of the frames 51 and those of the bases 52 by bolts 8 as shown in FIGS. 3 and 4. The diagonal members 6 are formed of steel materials, such as shape steel and steel pipes. For example, steel pipes are used, the gusset plates 11 are welded to the diagonal members 6 in a diagonal member-holding state.

The core member 4 is joined to the upper structure 1 and suspended therefrom, and it is inserted through the frames 51 of all of the vibrating units 5 and joined at its lower end portion to the bases 52 of the innermost circumferential side vibrating units 5. The core member 4 is formed of concrete or a material having a compressive strength equal to that thereof besides a steel material, such as a steel pipe and shape steel.

In the seismic isolator of FIGS. 1 and 2, the core member 4 is joined to a basis 7 of the upper structure 1 by a bolt 8 but the method of connecting the core member 4 and the basis 7 of the upper structure 1 together is not specially limited as long as the connected condition of them can be retained when the upper and lower structures 1, 2 are relatively displaced.

FIGS. 1 and 2 show a concrete example of the seismic isolator 3 which is formed of triangular frames and bases 51, 52, and vibrating units 5 formed to the shape of triangular prisms by three suspension members 53 extended between apexes of the frames and bases 51, 52, and FIGS. 3–7 the details of the example of FIGS. 1 and 2.

When the vibrating units 5 are formed to the shape of triangular prisms, the frames 51 of the vibrating units 5 positioned on the inner circumferential side, the bases 52 of the vibrating units 5 positioned on the outer circumferential side and the diagonal members 6 extended therebetween form three-dimensional trusses. Since the frames 51, diagonal members 6 and bases 52 form a framework of a high rigidity and a high strength, the stability of the framework at the time of occurrence of vibration becomes high.

Referring to FIGS. 1 and 2, the shape in plan and sizes in plan of the vibration unit 5 positioned on the innermost circumferential side and those of the vibrating unit 5 adjacent to the outer circumference thereof are set identical, and the shape in plan and sizes in plan of the vibrating unit 5 positioned on the outer circumferential side of the second-mentioned vibrating unit 5 and those of the vibrating unit adjacent to the outer circumference of the third-mentioned vibrating unit 5 and positioned on the outermost circumferential side are also set identical. Whether the sizes in plan of adjacent vibrating units 5, 5 are set equal, or whether they are set different is determined freely depending upon an area of installation of the seismic isolator 3 and a design amplitude of the vibrating units 5.

The frames 51 may be formed to any shape in plan as long as they do not hinder the relative displacement of the core member 4, which is inserted through the inner circumferential portions of the frames 51, with respect to the frames 51. The frames 51 are formed to a triangular shape shown in the drawings, a square shape, or a polygonal shape having not less than five corners, or a circular shape.

The frames 51 and bases 52 are assembled into a framework of a polygonal shape by combining rigid steel material, such as wire rods of shape steel and steel pipes and fixing them to one another by bolts and welding; and forming plate type members by processing face bars, such as steel plates to polygonal or circular shape. In the example of FIGS. 1 and 2, angle bars are butt welded to be assembled into frames 51 and bases 52.

Since the core member 4 is inserted into the frames 51, the frames 51 have to be formed to such a shape that does not hinder the relative displacement of the core member 4. Therefore, in order to form the frames 51 of steel plates, openings larger than the cross section of the core member 4 are made in the portions thereof through which the core member 4 is inserted.

When a lower end portion of the core member 4 is joined to a damper on the lower structure 2, for example, when the same lower end portion is inserted into a viscous fluid provided in the lower structure to utilize the resistance, which the outer surface of the core member 4 receives from the viscous fluid, as a damping force for the purpose of minimizing the vibration in the horizontal direction or in a direction perpendicular thereto by utilizing the relative displacement of the core member 4 and lower structure 2 during the vibration of the lower structure 2, the core member 4 passes through the bases 52. When the core member 4 does not pass through the bases 52, it is not necessary to make openings in the bases 52, and, in such a case, the bases formed of steel plates are used in the form of original blind plates. Even when the core member 4 passes through the bases 52, the bases 52 are displaced with the core member 4, so that openings as large as those made in the frames 51 do not have to be formed.

The lower end of the core member 4 is joined to the bases 52 positioned on the innermost circumferential side. Therefore, when the bases 52 are assembled by using steel materials, steel materials to which the core member 4 is to be joined are disposed among basic steel materials. In the example of FIGS. 1 and 2, bracing struts 41 are provided around the core member 4, i.e., between the core member 4 and bases 52 so as to prevent the core member 4 from being inclined with respect to the bases 52.

The suspension members 53 are arranged uniformly in the circumferential direction of the frames 51 and bases 52, and, when the frames 51 and bases 52 are polygonal, the suspension members 53 are provided on the apex portions thereof. When the frames 51 and bases 52 are circular, gusset plates are provided on the portions thereof which correspond to apex portions of an imaginary polygon so that the gusset plates project outward from the outer circumferences of the frames 51 and bases 52, whereby the suspension members 53 can be provided in the same manner as in the case where the frames 51 and bases 52 are polygonal.

Since the suspension members 53 normally bear a tensile force, steel materials, such as reinforcing steel, shape steel and steel pipes are used besides cables and wires to manufacture the same. Since the suspension members 53 are inclined with respect to the frames 51 and bases 52 during the vibration of the vibrating units 5, they are joined to the frames 51 and bases 52 so that the suspension members can be turned freely around a horizontal axis of the seismic isolator or inclined freely. In some cases, the suspension members 53 are joined to the frames 51 and bases 52 so that they can be turned freely around a vertical axis of the seismic isolator so as not to impart a torsional force to a joint portion thereof with respect to the frames 51 and bases 52.

Figure 5:
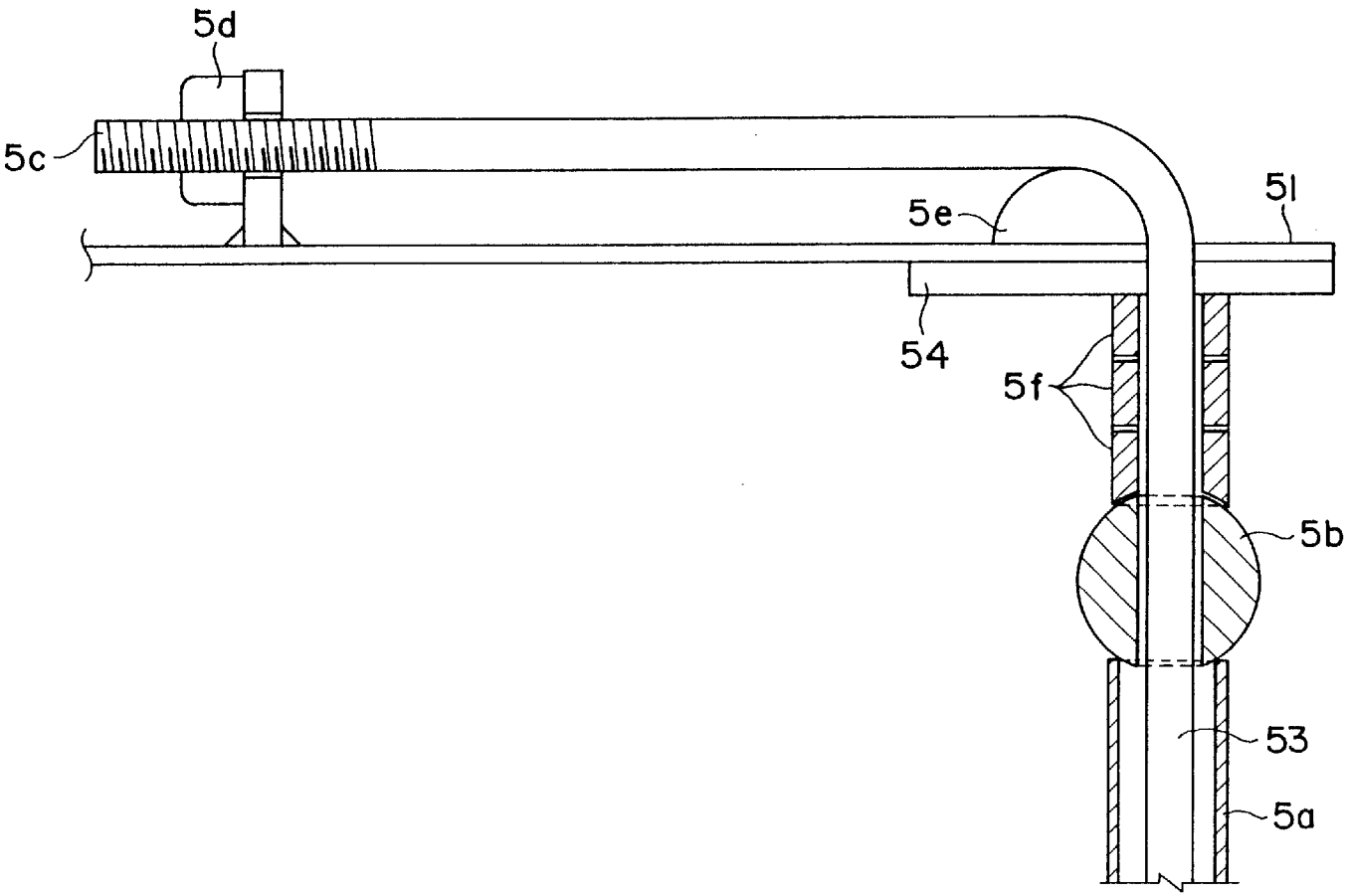
FIG. 5 is an elevational view showing the tie-in of a suspension member and a frame.
Figure 6:
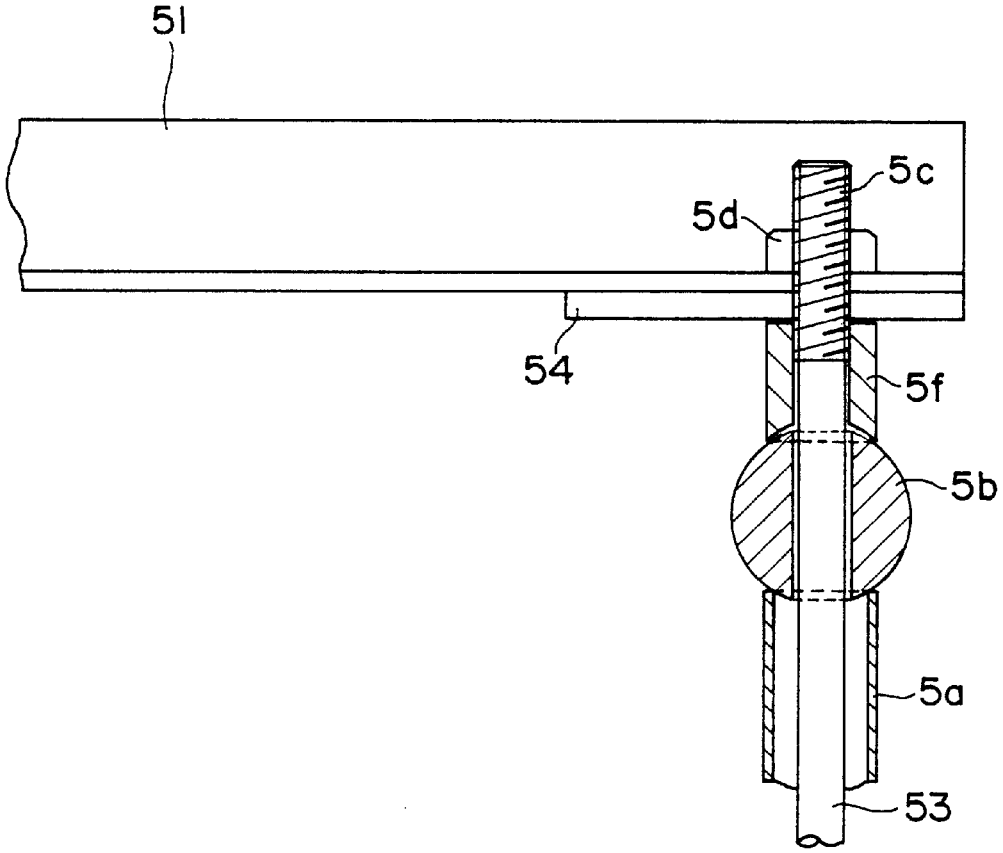
FIG. 6 is an elevational view showing another type of tie-in of a suspension member and a frame.

In the seismic isolator of FIGS. 1 and 2, wires are used as the suspension members 53. In order that the suspension members 53 can bear a compressive force when relative displacement occurs in the vertical direction between the upper and lower structures 1 and 2, with the distance between the frames 51 and bases 52 maintained, a pipe 5*a*, such as a steel pipe is provided around each wire as shown in FIGS. 5 and 6. In order that the pipe 5*a* in this case can be inclined freely with respect to the frames 51 and bases 52, ball hinges 5*b* are provided between the pipe 5*a* and frames 51 and between the pipe 5*a* and bases 52, and the wire is inserted through the interior of the ball hinges 5*b*.

In order that the pipe 5*a* in this example is relatively turned and displaced easily as it contacts the ball hinge 5*b*, a lower end portion of the ball hinge 5*b* is fitted in an inner portion of the pipe 5*a*. The diameter of a hole, through which the wire is inserted, made in the ball hinge 5*b* is smaller than the inner diameter of the pipe 5*a*, i.e., it is set to substantially such a level that does not cause the pipe 5*a* to be caught in the hole.

In the example of FIGS. 5 and 6, spacers 5*f* for regulating a suspended length of the wire are interposed between the frame 51 and ball hinge 5*b*. In order that the ball hinge 5*b* is relatively turned easily with respect to the spacers 5*f* as well, and in order that a lower end portion of the spacers 5*f* is not caught in a hole of the ball hinge 5*b*, the surface of the lowermost spacer 5*f* which contacts the ball hinge 5*b* is formed concavely, and an upper end portion of the ball hinge 5*b* is fitted in a recess thus formed to enable the lowermost spacer 5*f* and ball hinge 5*b* to surface contact each other.

In the seismic isolator of FIGS. 1 and 2, the end portions of the wires constituting the suspension members 53 are passed through the suspending portions of the frames 51 and fixed to predetermined portions thereof. In the examples of FIGS. 5 and 6, a bolt 5*c* is welded to an end portion of each wire, and fixed by a nut 5*d*.

FIG. 5 shows an example, in which the portion of the wire which is inserted through the frame 51 is bent, and fixed to the frame 51 with the bolt 5*c* portion laid horizontally. FIG. 6 shows an example, in which the bolt 5*c* is fixed at the portion thereof which is passed through the frame 51. In the case of the example of FIG. 5, a receiving member 5*e* having a curved surface on the portion thereof which is on the side of the wire is provided on a contacting portion, i.e. a boundary portion of the wire which is between the fixed portion and suspending portion thereof, so as to prevent the wire from being broken at the bent portion thereof.

Figure 7:
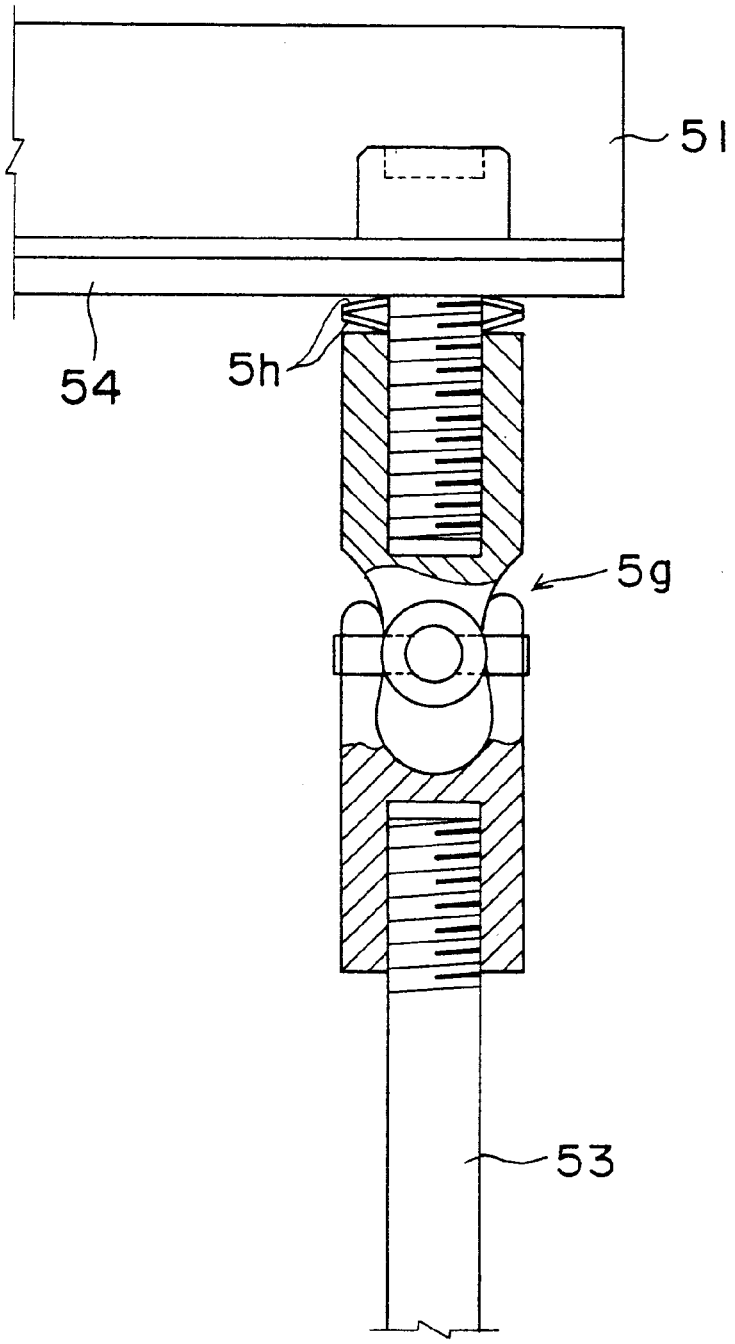
FIG. 7 is an elevational view showing still another type of tie-in of a suspension member and a frame.

FIG. 7 shows a case where steel rods threaded at opposed end portions thereof are used as a suspension member 53. In this case, the suspension member 53 is joined to the relative frame 51 and base 52 via a metal joint member 5*g* constituting a universal joint. Referring to FIGS. 3–7, a reference numeral 54 denotes a reinforcing plate for strengthening the corner portions of the frames 51 and bases 52.

In the example of FIG. 7, a spring 5*h* comprising a disc spring, a coiled spring or a ring spring adapted to cut off the vertical vibration of the lower structure 2 with respect to the upper structure 1 is interposed between the metal joint 5*g* and frame 51. In some cases, a damper, such as an oil damper or a viscous damper for damping the vertical vibration by utilizing relative displacement between the frame 51 and metal joint 5*g* occurring when the base 52 floats with respect to the frame 51 is provided instead of the spring between the metal joint 5*g* and frame 51.

The damping (not shown) of the vibration of the lower structure 2 in the horizontal direction or in the direction perpendicular thereto with respect to the upper structure 1 can be done as described above, by passing the lower end portion of the core member 4 through the base 52 and immersing the same in a viscous fluid provided in the lower structure 2.

FIGS. 12–15 and 16–19 show an example of the tie-in of a frame 51, suspension members 53 and diagonal members 6 in which adjacent horizontal members 51*a*, 51*a* which are constituent members of the frame 51, and which comprise steel rods threaded at both end portions thereof, are joined together at opposed end portions thereof by using a U-shaped bolt 51*b* bent in the shape of the letter "V" to form the equilaterally triangular frame 51. The horizontal members 51*a* are joined to the U-shaped bolt 51*b* via couplers 51*c*.

The threads on end portions of the horizontal members 51*a* screwed to the couplers 51*c* and those on end portions of the U-shaped bolt 51*b* are formed in the opposite directions. The distance between the end portion of each horizontal member 51*a* and the relative end portion of the U-shaped bolt 51*b* is regulated by turning the relative coupler 51*c*. After the distance between the horizontal members 51*a* and U-shaped bolt 51*b* has been regulated, nuts 51*d*, 51*d* are finally tightened to complete the combining of the horizontal members 51*a* and U-shaped bolt 51*b* with each other.

Figure 12:
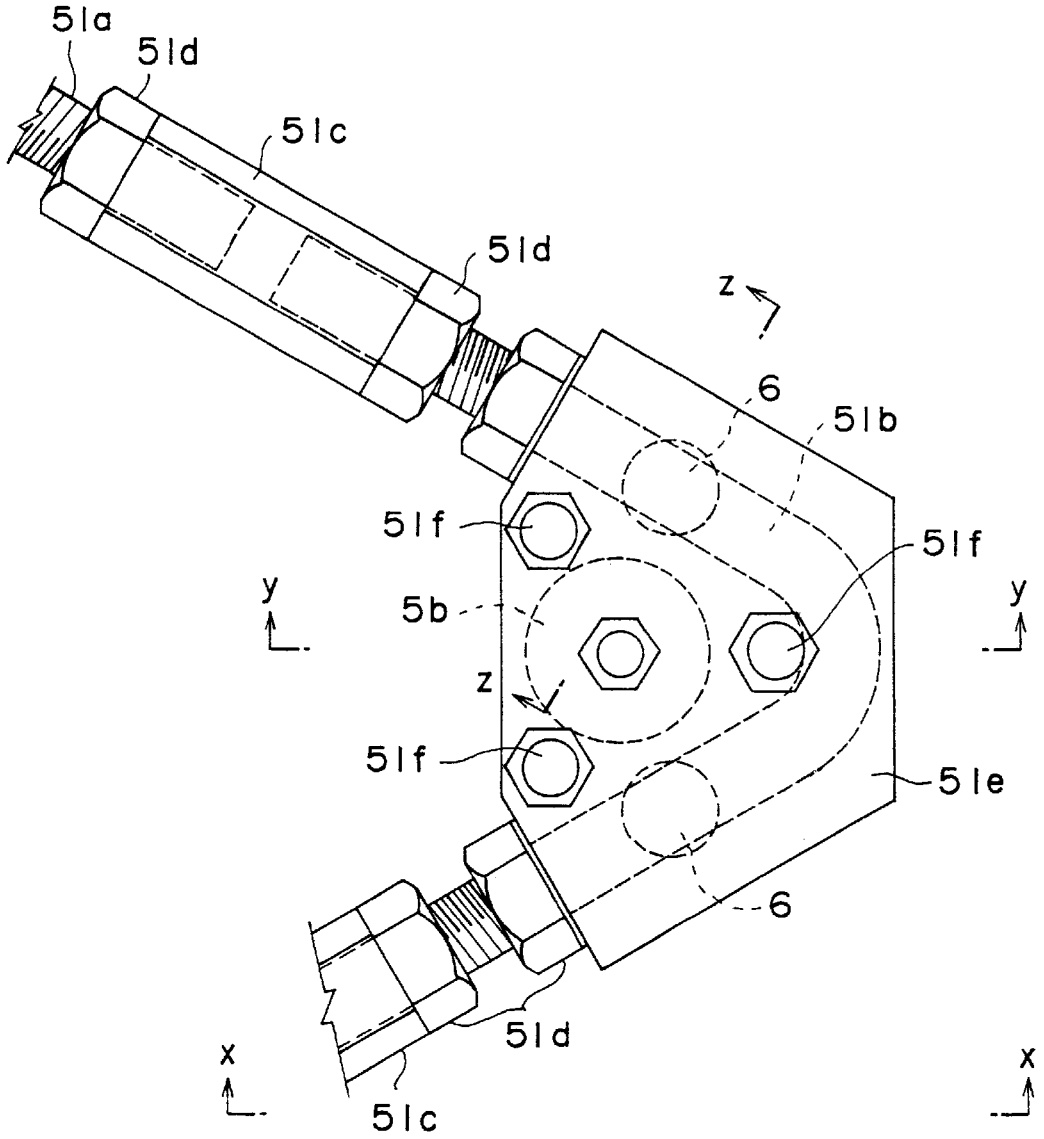
FIG. 12 is a plan view showing an example of connection of end portions of constituent members of a frame.
Figure 13:
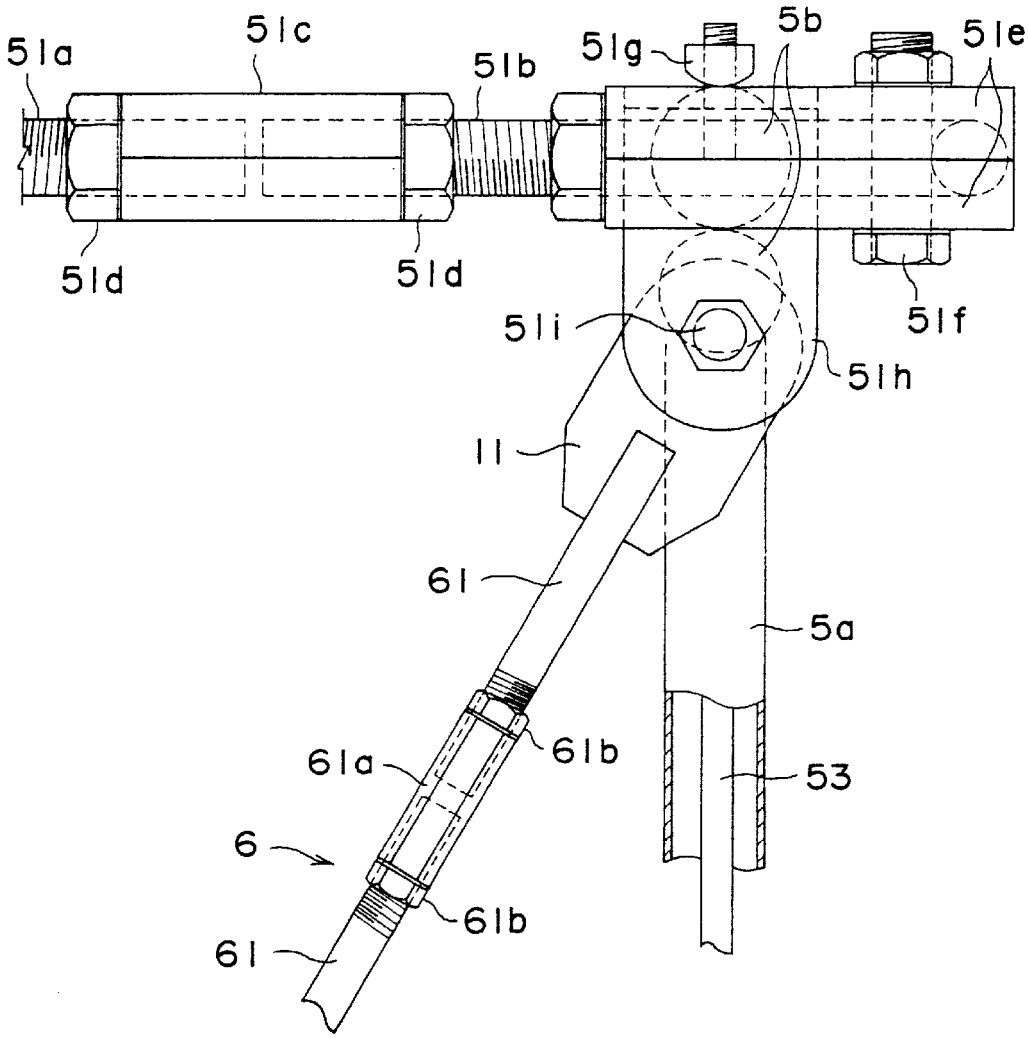
FIG. 13 is a view taken in the direction of bent arrows x—x in FIG. 12.
Figure 14:
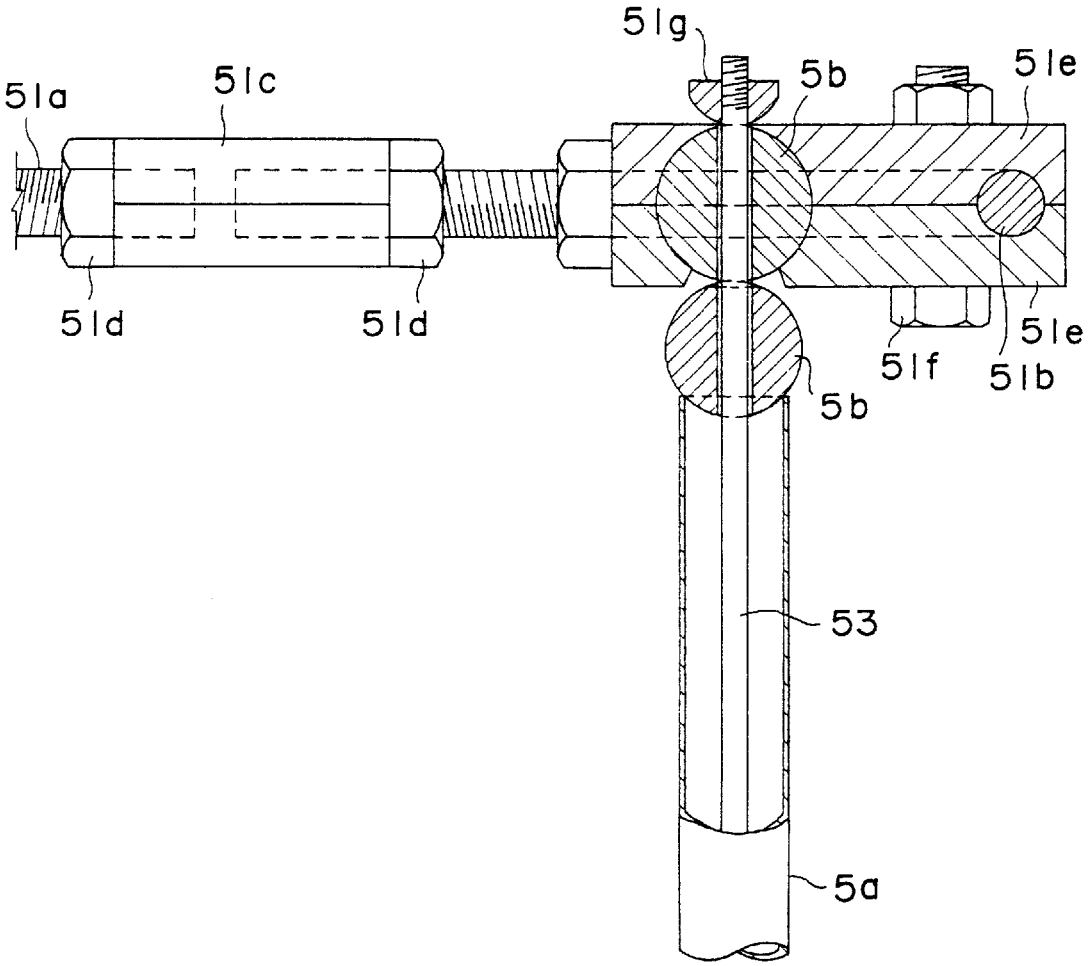
FIG. 14 is a sectional view taken in the direction of bent arrows y—y in FIG. 12.

FIGS. 12–15 show an example in which a suspension member 53 is suspended from covering plates 51*e*, 51*e* with the covering plates 51*e*, 51*e*, which are adapted to hold the U-shaped bolt 51*b* from the upper and lower sides thereof as shown in FIG. 13, a drawing taken in the direction of bent arrows x—x in FIG. 12, and FIG. 14, a drawing taken in the direction of bent arrows y—y in FIG. 12, holding a ball hinge 5*b* which is joined to an upper end portion of the suspension member 53.

The paired covering plates 51*e*, 51*e* are provided in opposed surfaces thereof with hemispherical recesses in which the ball hinge 5*b* is held and cross-sectionally semicircular recesses in which the U-shaped bolt 51*b* is held. The covering plates 51*e*, 51*e* are joined together by a bolt 51*f* with the ball hinge 5*b* and U-shaped bolt 51*b* held therebetween. After the covering plates 51*e*, 51*e* have been joined together, nuts 51*d* screwed on shaft portions of the U-shaped bolt 51*b* in addition to the couplers 51*c* are finally tightened against end surfaces of the covering plates 51*e*, 51*e*.

The recesses in which the ball hinge 5*b* is held of the covering plates 51*e*, 51*e* have a size large enough to permit the ball hinge 5*b* to rotate freely therein when the covering plates are joined together by the bolt 51*f*. In order that the ball hinge 5*b* can rotate freely in the recesses, a frictional force occurring between the surface of the ball hinge 5*b* and those of the recesses is reduced by inserting a low friction material, such as an oil, a bearing, a Teflon plate or the like therebetween.

In the example shown in FIGS. 13 and 14, a PC steel member, such as a PC steel rod is used as the suspension member 53, and a pipe 5*a* is provided around the suspension member 53 as in the case of FIG. 5. In order that the pipe 5*a* can be turned with respect to the ball hinge 5*b*, two ball hinges 5*b*, 5*b* are provided in series on an upper end of the pipe 5*a*, and an upper ball hinge 5*b* is held between the covering plates 51*e*, 51*e*.

The suspension member 53 passes through two ball hinges 5*b*, 5*b*, and is fixed to the upper ball hinge 5*b* or to the upper covering plate 51*e* by a nut 51*g* having a spherical seat surface. In this case, the suspension member 53 is inclined with respect to the frame 51 owing to the rotation of the ball hinge 5*g* held between the covering plates 51*e*, 51*e* in the recesses.

Figure 15:
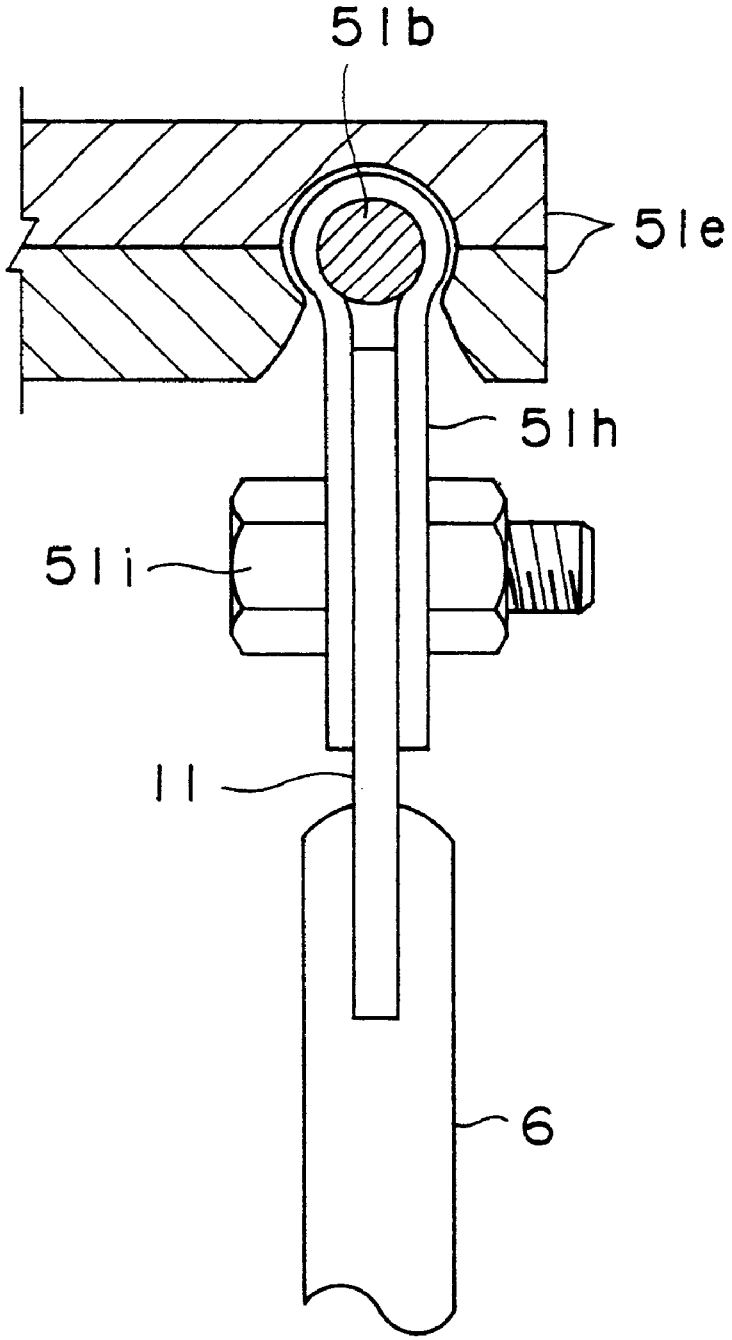
FIG. 15 is a sectional view taken in the direction of bent arrows z—z in FIG. 12.

A gusset plate 11 joined to an upper end portion of a diagonal member 6 is joined to a clip type U-shaped gusset plate 51*h*, which is supported on a U-shaped bolt 51*b*, by a bolt 51*i* as shown in FIG. 15 which is a sectional view taken in the direction of bent arrows z—z in FIG. 12. The U-shaped gusset plate 51*h* is fitted around each shank portion of the U-shaped bolt 51*b* except the bent portion thereof and supported on the same bolt 51*b*.

As shown in FIG. 15, a recess, in which the U-shaped bolt 51*b* is held, in the portion of the lower covering plate 51*e* in which the U-shaped gusset plate 51*h* is provided extends through the lower covering plate 51*e* vertically to cause a lower surface thereof to be opened, so that the U-shaped gusset plate 51*h* is joined to both the U-shaped bolt 51*b* and covering plates 51*e*, 51*e* with the U-shaped gusset plate 51*h* capable of being turned around the shank portion of the U-shaped bolt 51*b* and not transmitting bending moment to the U-shaped bolt 51*b* and covering plates 51*e*, 51*e*.

Figure 16:
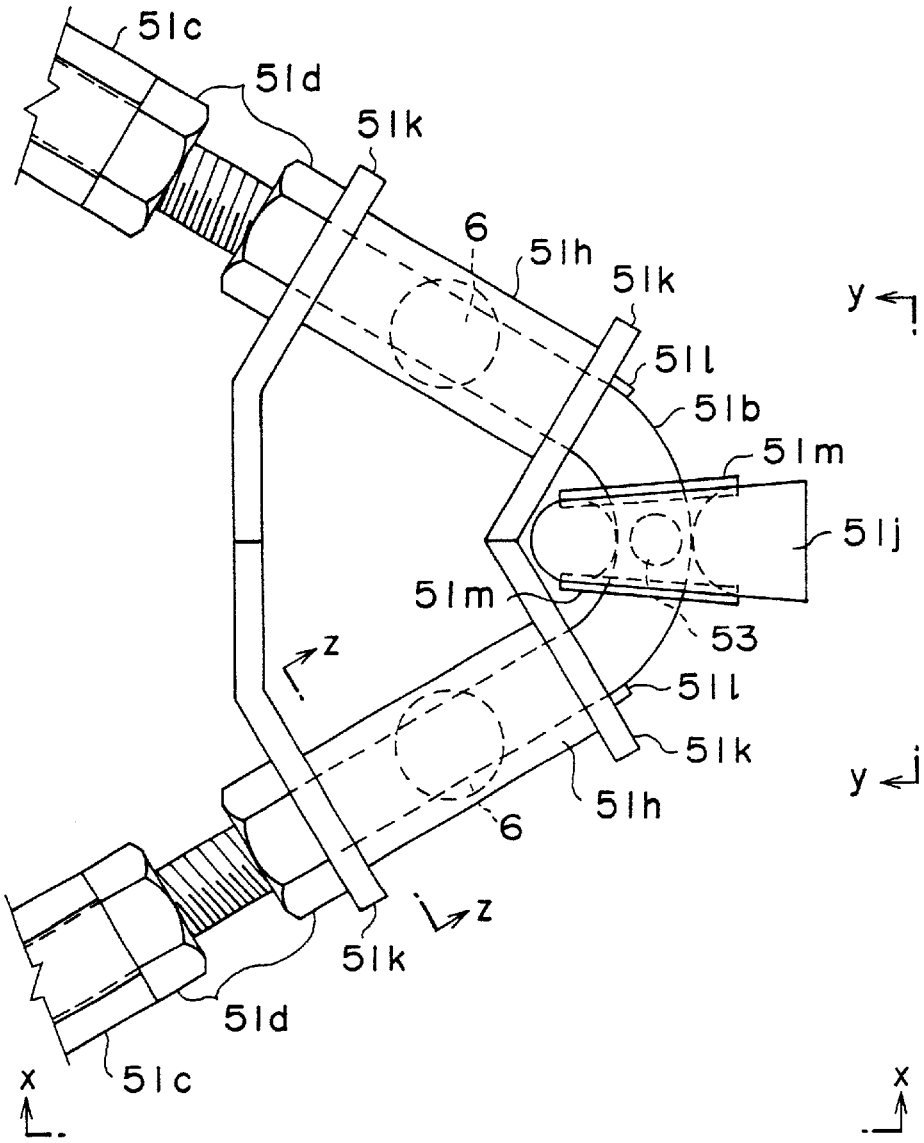
FIG. 16 is a plan view showing another example of connection of end portions of constituent members of a frame.
Figure 17:
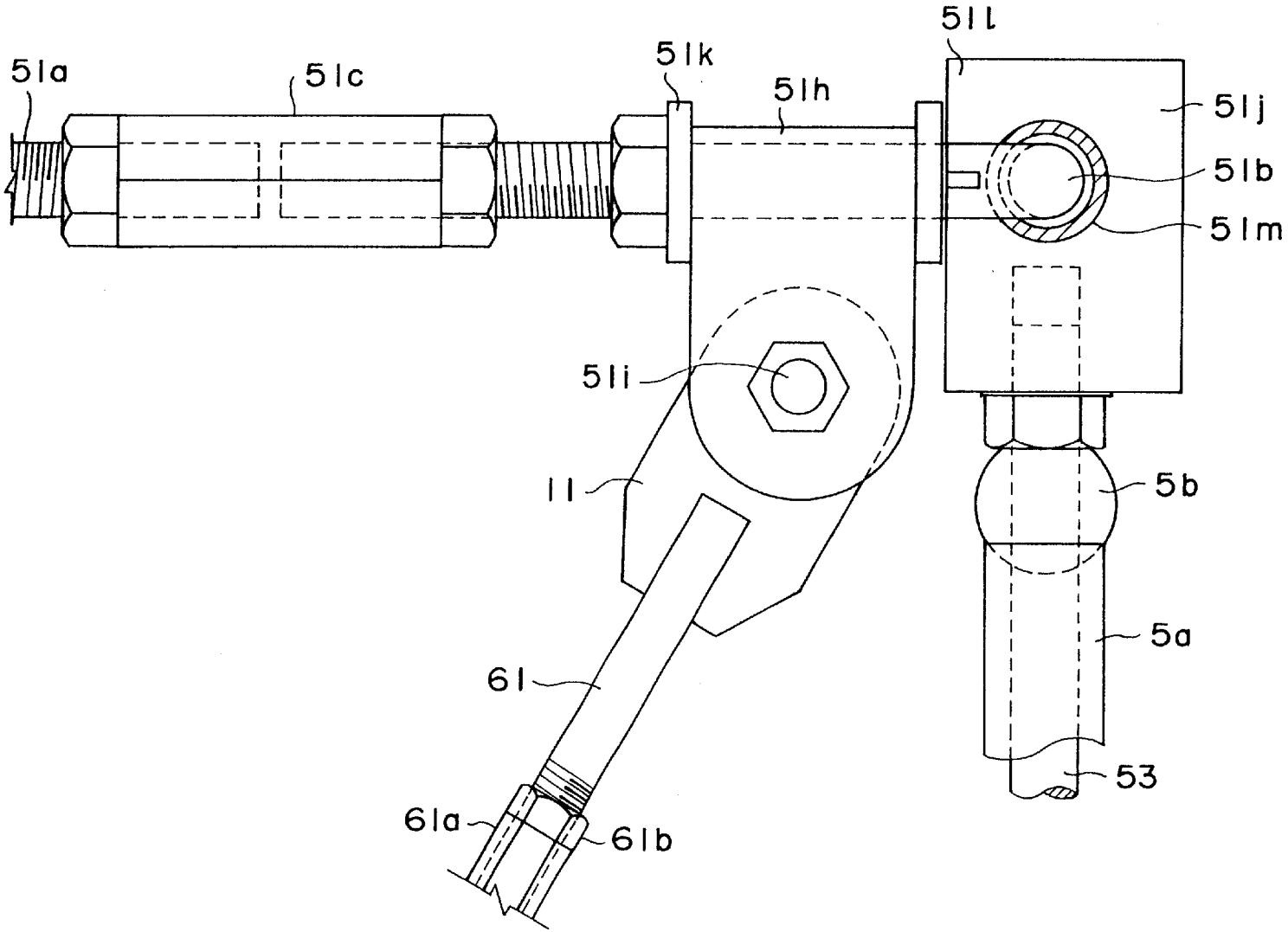
FIG. 17 is a view taken in the direction of bent arrows x—x in FIG. 16.
Figure 18:
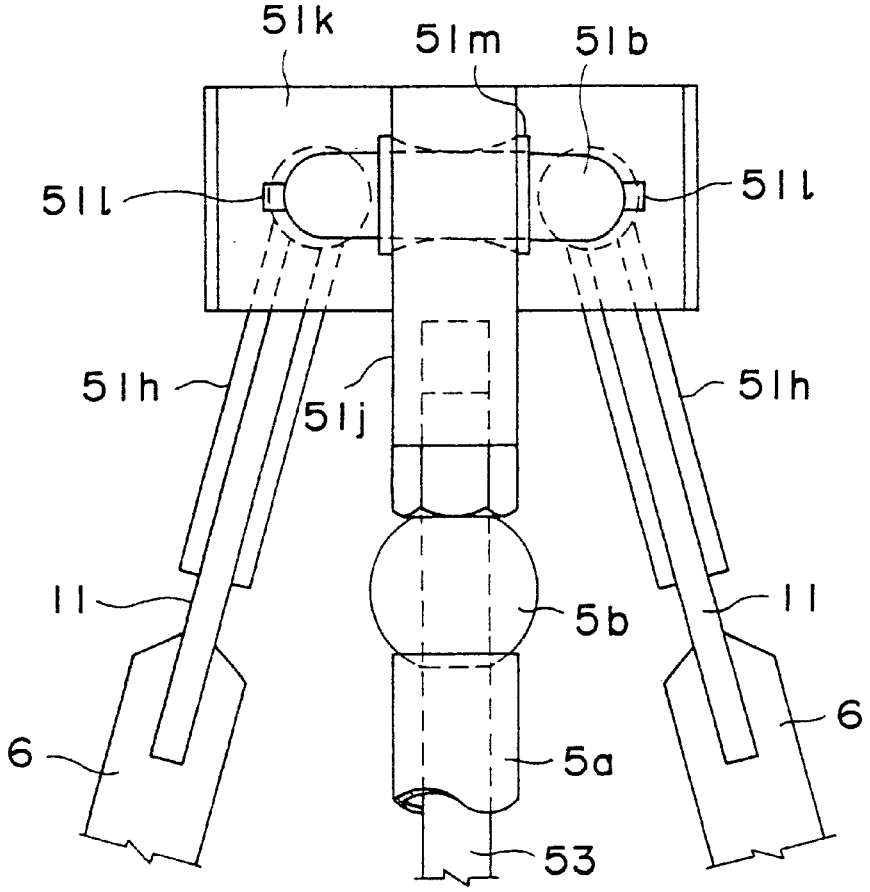
FIG. 18 is a view taken in the direction of bent arrows y—y in FIG. 16.
Figure 19:
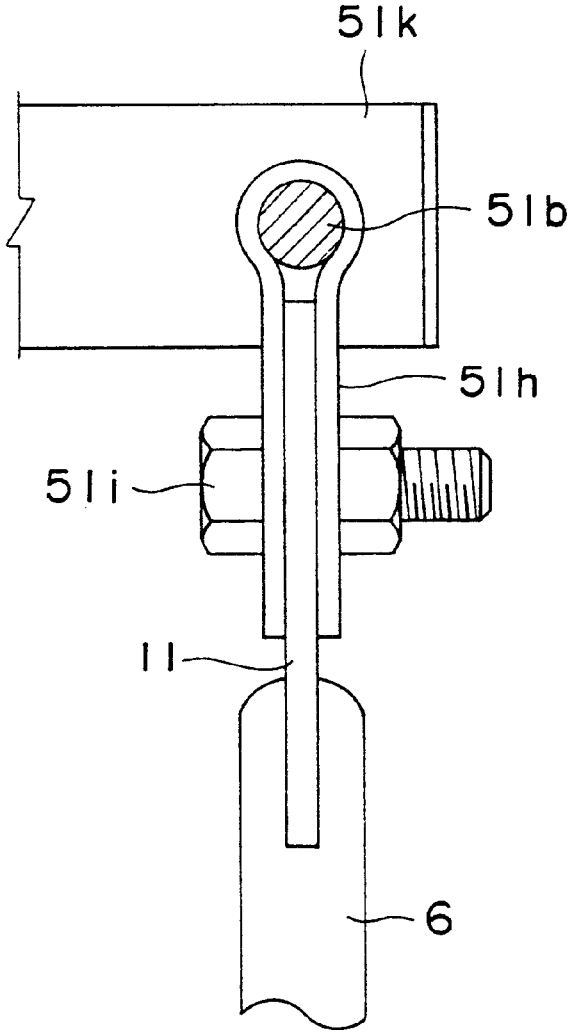
FIG. 19 is a sectional view taken in the direction of bent arrows z—z in FIG. 16.

FIGS. 16–19 show a case concerning the frame 51 in which a metal suspension member 51*j* is supported on a U-shaped bolt 51*b* at an outer side thereof with a suspension member 53 hung from the metal suspension member 51*j* as shown in FIG. 17 which is a drawing taken in the direction of bent arrows x—x in FIG. 16. In this case, a U-shaped gusset plate 51*h* is supported on each shank portion of the U-shaped bolt 51*b* so that the gusset plate can be turned therearound, as shown in FIG. 19 which is a sectional view taken in the direction of bent arrows z—z in FIG. 16.

On the shank portions of the U-shaped bolt 51*b*, two width restricting plates 51*j*, 51*j* for restricting the axial movements of the U-shaped gusset plates 51*h* are provided, and the U-shaped gusset plates 51*h* are supported between these width restricting plates 51*j*, 51*j*. The width restricting plate 51*j* closer to a bent portion of the U-shaped bolt 51*b* is engaged with stoppers 51*l*, which are fixed to the U-shaped bolt 51*b*, and thereby fixed in the positions.

After the width restricting plates 51*j*, 51*j* have been provided on the shank portions of the U-shaped bolt 51*b* in a symmetric manner with respect to a symmetry axis of the U-shaped bolt 51*b* as shown in FIG. 16, they are joined together by welding or bolts to prevent the two shank portions of the U-shaped bolt 51*b* from being deformed, and secure the rigidity of the U-shaped bolt 51*b*.

Since the metal suspension member 51*j* is provided around the bent portion of the U-shaped bolt 51*b* which bent portion therefore passes therethrough, it is supported rotatably on the U-shaped bolt 51*b*. Referring to the drawings, a female thread-carrying hole is formed in a lower end portion of the metal suspension member 51*j*, and an upper end portion of the suspension member 53 is screwed into this female thread-carrying hole to be joined thereto. In accordance with this arrangement, the metal suspension member 51*j* is supported on the bent portion of the U-shaped bolt 51*b* rotatably around two horizontally extending axes so as to enable the suspended member 53 to be inclined freely with respect to the frame 51.

In order to attenuate the relative rotation of the metal suspension member 51*j* with respect to the U-shaped bolt 51*b* in the illustrated example, a ring-shaped damping rubber member 51*m* is interposed between a circumference of the bent portion of the U-shaped bolt 51*b* and the through hole of the metal suspension member 51*j* as shown in FIGS. 16, 17 and 18 which is a drawing taken in the direction of bent arrows y—y in FIG. 16.

Figure 20:
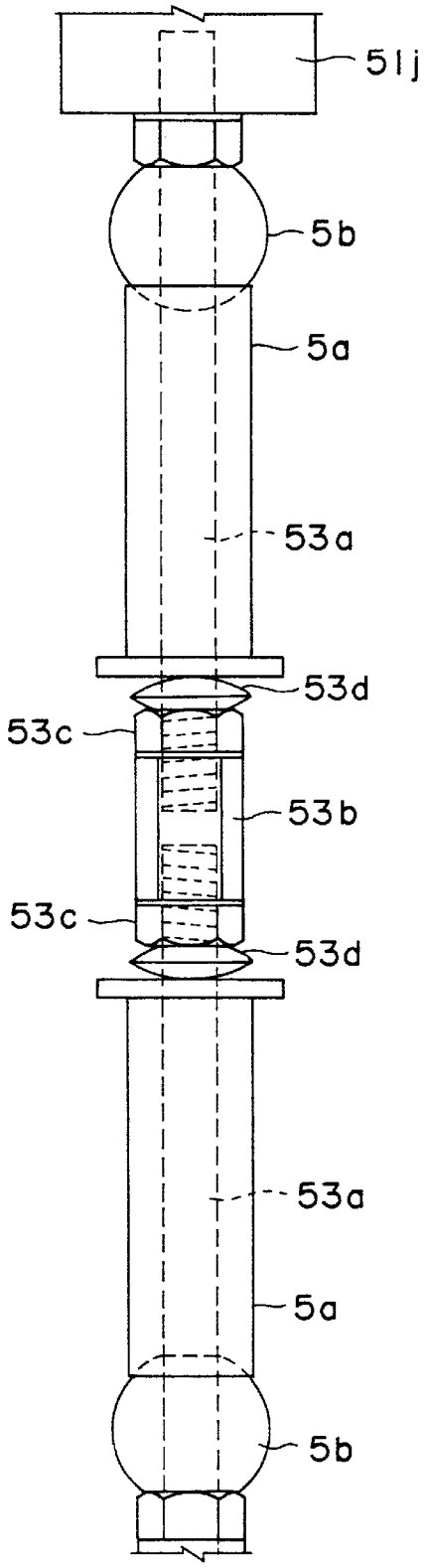
FIG. 20 is an elevational view showing an example of connection of tension members in a case where a suspension member is formed of a plurality of tension members.

FIG. 20 shows an example of the construction of the suspension member 53 joined to the metal suspension member 51*j* shown in FIGS. 16–19. In this example, the suspension member 53 comprises a plurality of tension members 53*a*, 53*a* separated axially and having threads on end portions thereof, which are joined to each other by a coupler 53*b* so that a total length of the suspension member 53 can be regulated. The levels of the bases 52 of the seismic isolator 3 are regulated by adjusting the length of the suspension member 53. The threads on the end portions of the two tension members 53*a*, 53*a* which are screwed to the coupler 53*b* are formed in the opposite directions.

After the distance between the end portions of the tension members 53*a*, 53*a* has been regulated, nuts 53*c*, 53*c* are tightened to complete the connection of the tension members 53*a*, 53*a*. In accordance with this arrangement permitting the distance between the end portions of the tension members 53*a*, 53*a* to be regulated by the coupler 53*b*, disc springs 53*d* constantly in close contact with the end surfaces of the pipes 5*a* which are on the sides of the coupler 53*b* and nuts 53*c* to prevent the loosening of the nuts 53*c* irrespective of the level of the mentioned distance are inserted between the pipes 5*a* and nuts 53*c*.

In the example of FIG. 13, the diagonal member 6 is divided into a plurality of axially extending compression members 61, 61 threaded at end portions thereof just as the suspension member 53 shown in FIG. 20. The compression members 61, 61 are joined together by a coupler 61*a*, whereby both the length of the suspension member 53 and a total length of the diagonal member 6 can be regulated. After the distance between the end portions of the compression members 61, 61 has been regulated, nuts 61*b*, 61*b* are tightened to complete the connection of the compression members.

In the examples shown in FIGS. 12–20, the frame 51 comprises horizontal members 51*a* and a U-shaped bolt 51*b*, and each of the suspension members 53 and diagonal members 6 axially extending divisional tension members 53*a* and compression members 61, the constituent parts of the frames 51, suspension members 53 and diagonal members 6 being joined together by couplers 51*c*, 53*b*, 61*a*. Since the parts and members of the seismic isolator 3 are thus divided respectively with the lengths of the respective parts and members able to be regulated, the assembling of the seismic isolator 3 and the regulating of an assembling error can be done easily.

Figure 9A:
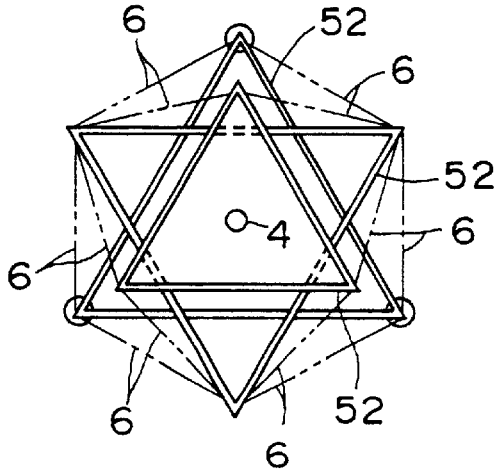
FIG. 9A is a plan view of what is shown in FIG. 8.
Figure 9B:
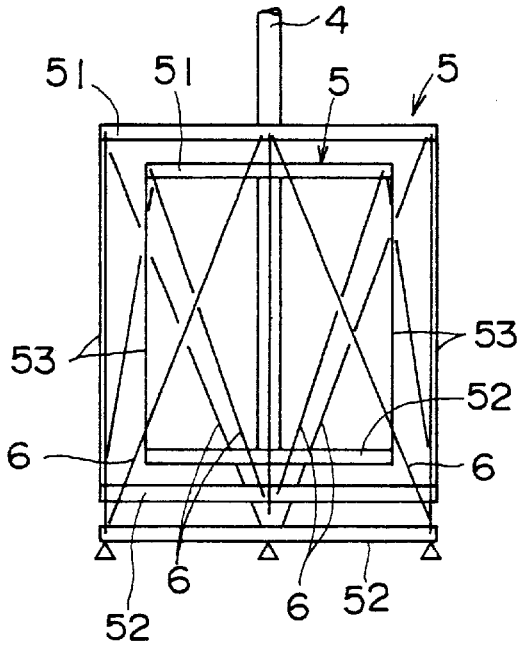
FIG. 9B is an elevational view of what is shown in FIG. 8.
Figure 10A:
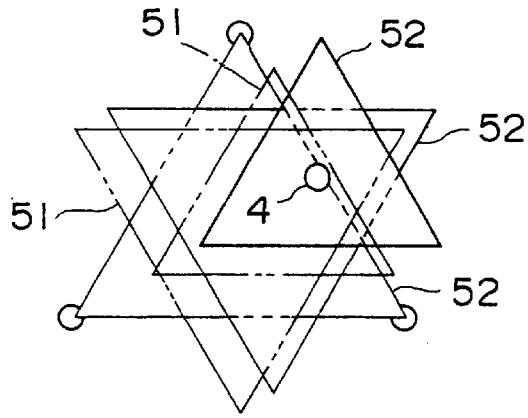
FIG. 10A is a plan view showing the condition in which displacement occurs in bases of FIG. 9A.
Figure 10B:
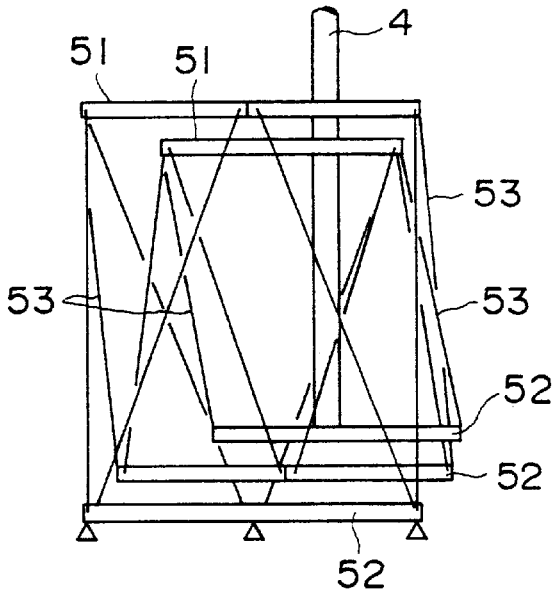
FIG. 10B is an elevational view of what is shown in FIG. 10A.

FIGS. 9A and 9B are a plan view and an elevational view of the seismic isolator 3 of FIG. 8, and FIGS. 10A and 10B the condition of the vibrating units 5 of the seismic isolator 3 of FIG. 9 which are displaced in the diagonal direction of triangles. Referring to FIG. 10A, solid lines designate bases 52, and chain lines frames 51.

As shown in FIG. 10, when the lower structure 2 is vibrated, the core member 4 joined to the base 52 of the innermost circumferential side vibrating unit 5 does not collide with all the frames 51 including the frame 51 supporting the mentioned base 52. The bases 52 are relatively displaced with respect to the frames 51 in a range in which the bases 52 of relatively inner circumferential side vibrating units 5 do not collide with the diagonal members 6 joined to the bases 52 of their outer circumferential side vibrating units 5, and, generally, relative displacement corresponding to the sum of the relative displacement of the bases 52 of the vibrating units 5 with respect to the frames 51 occurs between the upper and lower structures 1, 2. During this time, the frames 51 of the relatively inner circumferential side vibrating units 5 and the bases 52 of the outer circumferential side vibrating units 5 behave together.

Figure 11A:
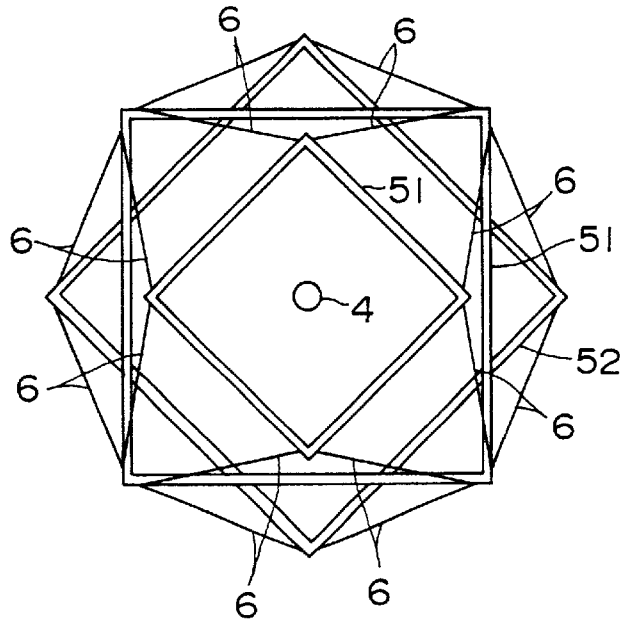
FIG. 11A is a plan view showing a seismic isolator formed of square vibrating units.
Figure 11B:
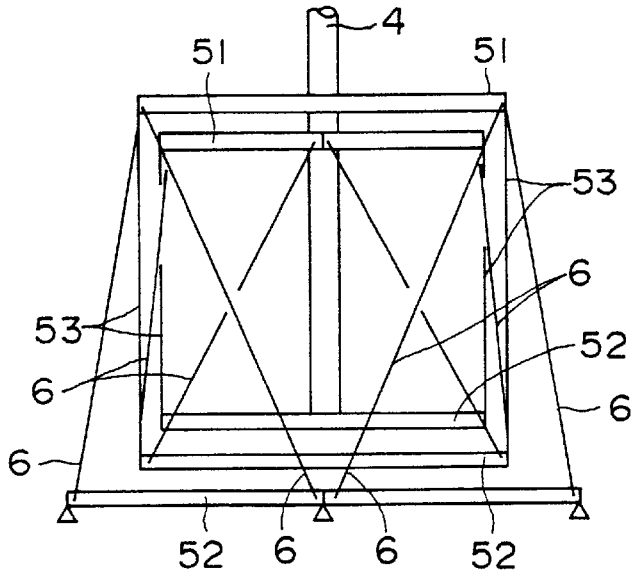
FIG. 11B is an elelvational view of what is shown in FIG. 11A.

FIGS. 11A and 11B show an example in which the shape in plan of vibrating units 5 is square. Suspension members 53 are arranged on the apexes of the square-shaped vibrating units, and diagonal members 6 are extended between the apexes of the frames 51 of adjacent vibrating units 5, 5 and those of the bases 52.

FIGS. 21–28 show examples of the construction of the diagonal members 6 in the seismic isolator 3 defined in claim 3 to which a function of absorbing an impact force occurring during an earthquake is added. An impact absorption member 12 expansible and contractible in the axial direction of the diagonal member 6 and having a capability of bearing a compressive force and a restoring force is provided at an end portion or an intermediate portion of the diagonal member 6.

The impact absorption member 12 is basically provided between the frames 51 of the vibrating units 5 positioned on the outermost circumferential side and lower structure 2, or in portions of the diagonal members 6 extended between the frames 51 and bases 52, and, in some cases, in portions of the diagonal members 6 on the inner circumferential side thereof.

FIGS. 21–26 show examples in which the diagonal member 6 is formed of a plurality of axially extending divisional compression members 61, 61 with an impact absorption member 12 interposed between adjacent compression members 61, 61, i.e., in an axially intermediate portion of the diagonal member 6. FIG. 27 shows an example provided with impact absorption members 12 on both end portions of a diagonal member 6.

Figure 21:
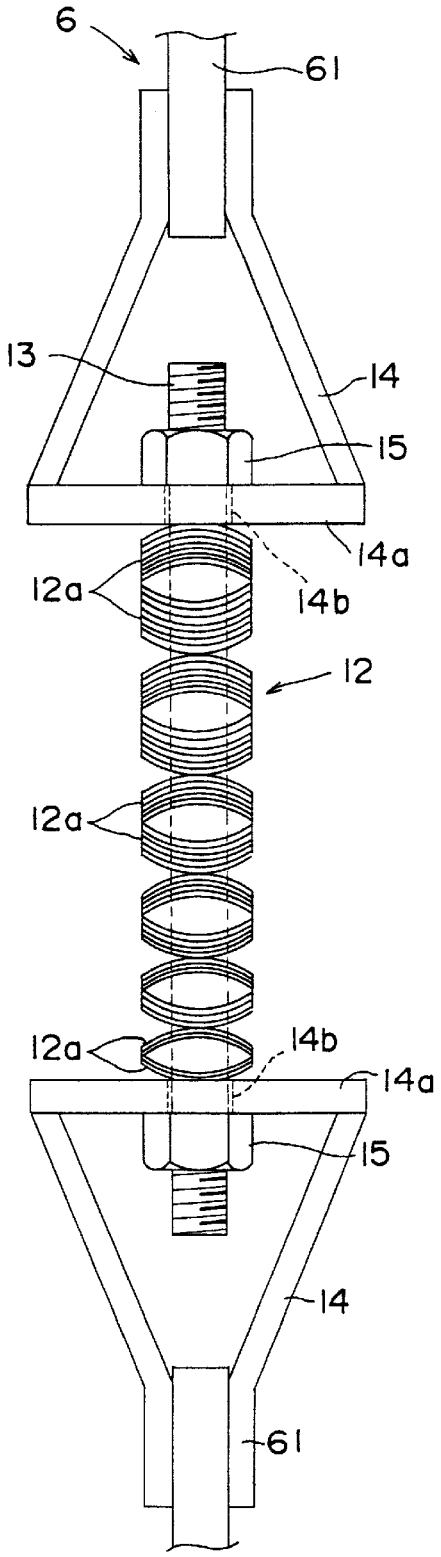
FIG. 21 is an elevational view showing a diagonal member constituting the seismic isolator defined in claim 3, which diagonal member comprises two compression members, and impact absorption members interposed therebetween.
Figure 22:
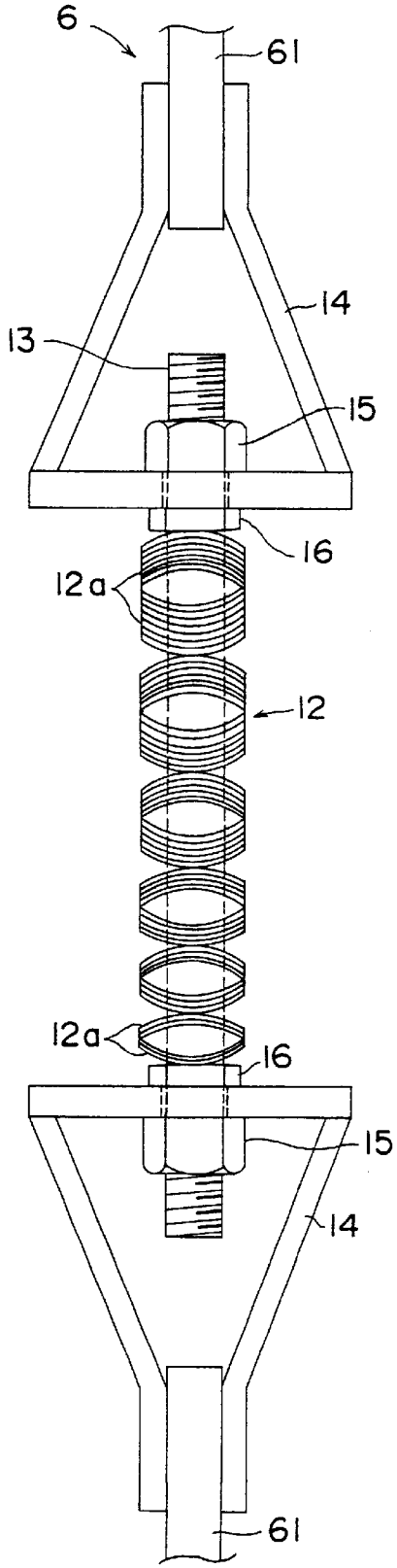
FIG. 22 is an elevational view showing a modified example of the diagonal member of FIG. 21.

FIGS. 21 and 22 show examples of connection of impact absorption members 12, in which a plurality of disc springs 12*a* of different spring constants are arranged in series to form an impact absorption member 12, all of the disc springs 12*a* being joined together by a bolt 13 and interposed between compression members 61, 61. The springs used as the impact absorption member 12 include coiled springs, ring springs 12*c* and plate springs besides disc springs 12*a*. In some cases, a plurality of bolts 13 (not shown) are provided between the compression members 61, 61, and impact absorption members 12 are parallel-arranged thereon.

Fixing members 14 to which the bolt 13 is fixed is joined to the end portions of the compression members 61 which are on the side of the impact absorption member 12, and the bolt 13 is passed through all of the disc springs 12*a* and the plates 14*a* of the fixing members 14 and joined at the end portions thereof to the plates 14*a* by nuts 15 so as to be engaged therewith toward the side of the impact absorption member 12. The diameter of a bolt hole 14*b* of the plate 14*a* of at least either one of the fixing members 14 is larger in diameter than that of the bolt 13, so that the end portion on the side of the larger bolt hole of the bolt 13 can be moved relatively toward the compression member 61 in accordance with the contraction of the disc springs 12*a*.

The compression members 61, 61 constituting the diagonal member 6 normally bear a compressive force. Accordingly, in the example of FIG. 21, the disc springs 12*a* also bear a compressive force, and absorb a compressive force further imparted to the compression members 61, 61 due to an impact force. Therefore, a spring constant of at least one disc spring 12*a* of a relatively high spring constant out of all of the disc springs 12*a* is set so that the disc spring in a normal state in which it bears a compressive force can further contract due to an impact force.

A disc spring 12*a* of a low spring constant fully contracts in some cases due to a compressive force which it normally bears. When a tensile force is exerted on the compression members 61, 61 due to an impact force, the contracted disc spring 12*a* expands to absorb the impact force.

When an impact force in the direction in which the two fixing members 14, 14 move toward each other is exerted on the example of FIG. 21, the disc springs 12*a* contract in order from the disc spring 12*a* of a low spring constant toward the disc spring 12*a* of a large spring constant in accordance with the level of the impact force, so that the impact force is absorbed in a plurality of stages. The amount of contraction of all the disc springs 12*a* during the contraction thereof is restricted by applying a compressive force to the disc springs 12*a* by exerting a tensile force on the bolt 13 in advance by the nuts 15.

As shown in FIG. 22, when nuts 16 which bear a normal compressive force, and which are threaded by an impact force added to the compressive force, are provided in series with respect to the disc springs 12*a*, on the surfaces of the fixing plates 14 which are on the side of the disc springs 12*a*, and engaged with the bolt 13, it becomes possible to have the bolt 13 alone bear a normal compressive force, prevent the disc springs 12*a* from bearing the normal compressive force, and have the disc springs 12*a* bear the compressive force only when the impact force is exerted on the fixing members.

In this case, the nuts 16 normally restrict the movement of the bolt 13 with respect to the fixing plates 14, so that the compressive force is borne by the bolt 13 alone. When the impact force is exerted on the fixing members, the ridges of the nuts 16 are broken to enable the bolt 13 to be moved freely with respect to the fixing members 14, and the disc springs 12*a* to bear the compressive force and impact force and contract. In this case, the disc springs 12*a* also contract in order from the disc spring 12*a* of a low spring constant toward the disc spring 12*a* of a high spring constant, so that the impact force is absorbed in a plurality of stages.

Figure 23:
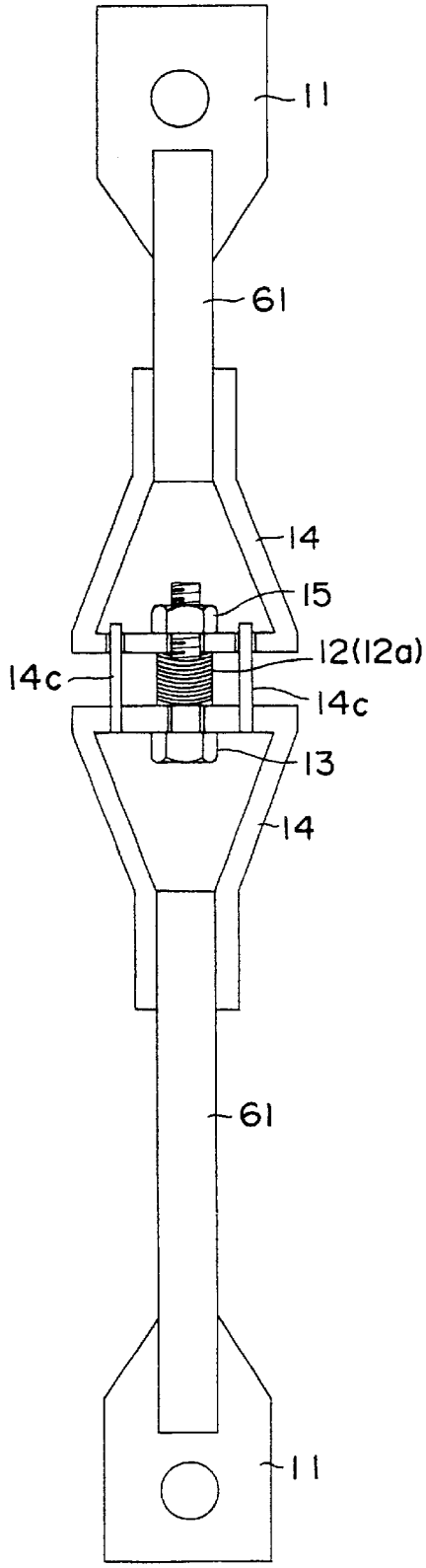
FIG. 23 is an elevational view of fixing members of FIG. 21 between which a guide rod is provided.
Figure 24:
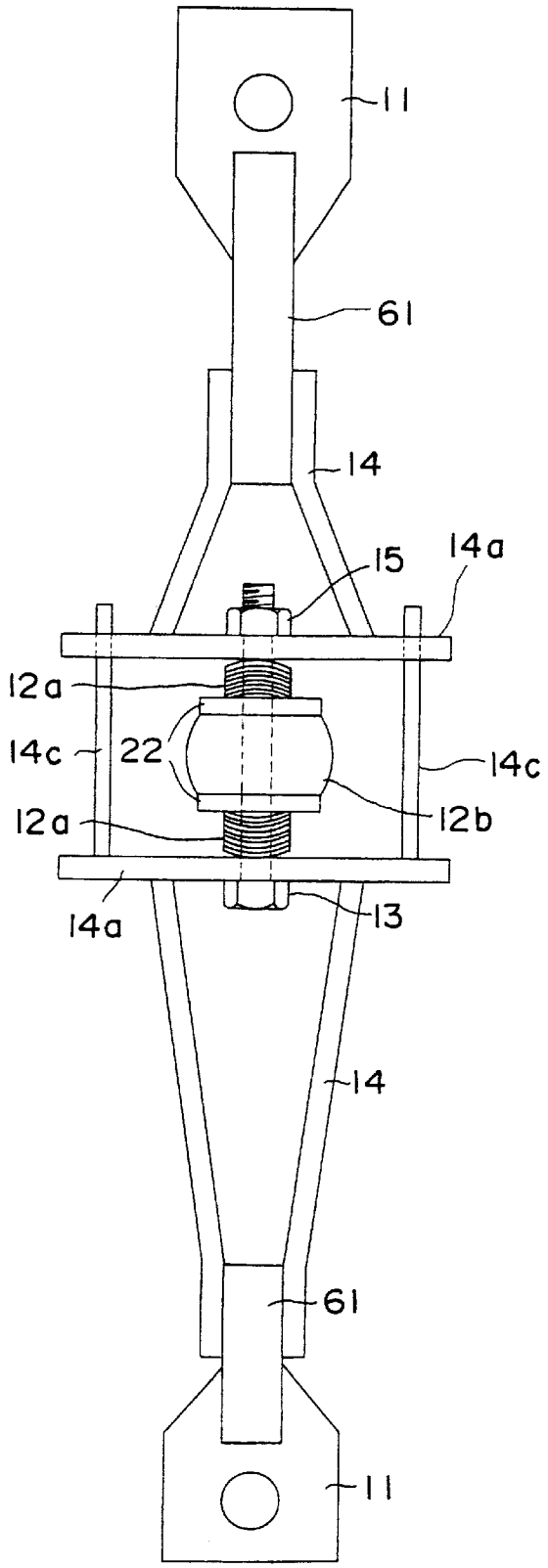
FIG. 24 is an elevational view showing a modified example of the fixing member of FIG. 23.

FIGS. 23 and 24 show an example in which guide rods 14*c* relatively movable in the axial direction of compression members 61 with respect to one of such fixing members 14, 14 as those of the example of FIG. 22 which are opposed to each other with an impact absorption member 12 held therebetween are fixed to the other fixing member 14 so as to restrain the fixing members 14, 14 so that relative distortion does not occur therebetween. The guide rods 14*c* are passed at their free end portions through one of the fixing members 14, 14 to such an extent that the guide rods 14*c* do not come off from the fixing member 14 when the fixing members 14, 14 are moved away from each other.

FIG. 23 shows an example in which a plurality of disc springs 12*a* are provided between the fixing members 14, 14 as in the example of FIG. 21, and FIG. 24 an example in which a rubber member 12*b* is held between such disc springs 12*a* as are shown in FIG. 23. When the rubber member 12*b* is used, both surfaces thereof are held by plates 22, 22 so that a compressive force is exerted uniformly on the whole of the surfaces of the rubber member 12*b*.

Figure 25B:
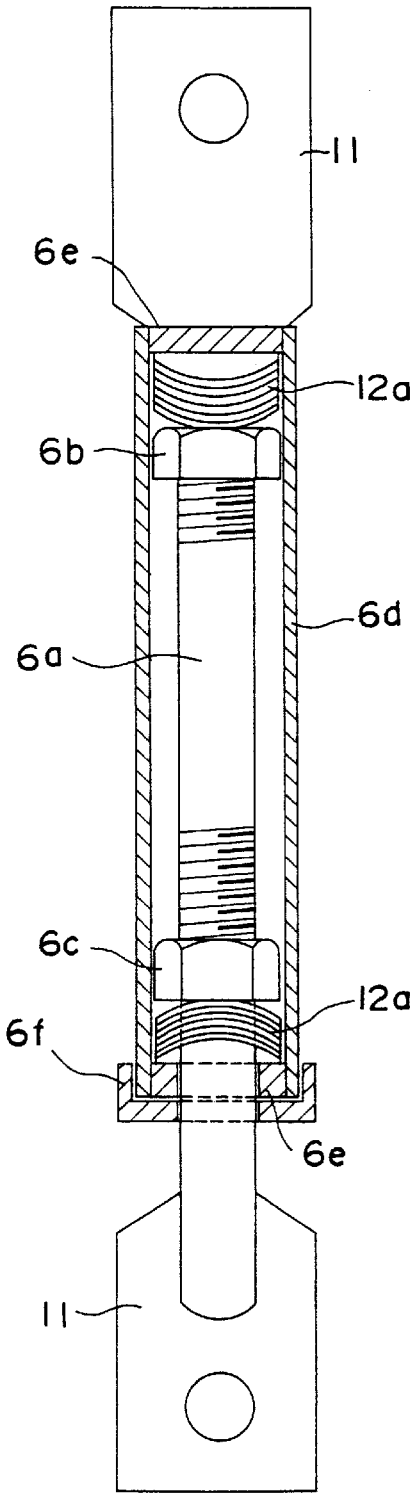
FIG. 25B is a sectional view of the diagonal member of FIG. 25A.
Figure 25A:
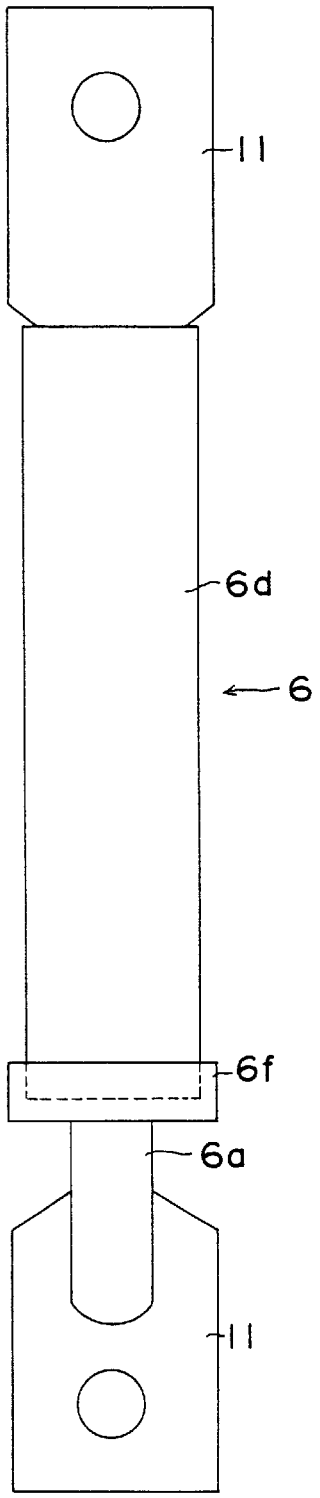
FIG. 25A is an elevational view of a diagonal member comprising a bolt and an outer tube.

FIG. 25 shows an example in which the diagonal member 6 is formed of a bolt 6*a* having a nut 6*c* screwed on an axially intermediate portion thereof, and an outer tube 6*d* allowing the portion of the bolt 6*a* which is between the section having the nut 6*c* thereon and a head section 6*b* thereof to be moved relatively and axially into and out of the same and having end plates 6*e*, 6*e* fixed to both end portions thereof, disc springs 12*a* being interposed between the head section 6*b* of the bolt 6*a* and one end plate 6*e* and between the nut 6*c* and the other end plate 6*e*. The bolt 6*a* is inserted into the outer tube 6*d* so that the end plate 6*e* on the side of the nut 6*c* can be moved relatively in the axial direction thereof.

The compressive force of the diagonal member 6 in a normal condition is borne by the disc spring 12*a* between the head section 6*b* of the bolt 6*a* and the end plate 6*e* thereon and the bolt 6*a*, and the disc spring 12*a* between the nut 6*c* and the end plate 6*e* thereunder bears a tensile force as a compressive force when the tensile force is exerted on the diagonal member 6.

The end portion, which is close to the nut 6*c*, of the bolt 6*a*, and the end portion, which is on the side of the head section 6*b* of the bolt 6*a*, of the outer tube 6*d* are joined to gusset plates 11, 11 which are used to join both end portions of the diagonal member 6 to the frames 51 and bases 52 of vibrating units 5.

A cap 6*f* having a flange and such an inner diameter that permits the cap to be fitted around the outer tube 6*d* is put around the portion of the outer tube 6*d* which is on the side of the gusset plate 11 to which the bolt 6*a* is fixed, whereby a movement of the outer tube 6*d* in all directions except the axial direction of the bolt 6*a* is restricted. The bolt 6*a* is passed through the cap 6*f* so that the cap 6*f* can be moved relatively and freely in the axial direction with the outer tube 6*d* with respect to the bolt 6*a*.

When an impact force causing the two gusset plates 11, 11 to be displaced toward each other occurs, the disc spring 12*a* interposed between the end plate 6*e* on the side of the gusset plate 11 to which the outer tube 6*d* is fixed and the head section 6*b* of the bolt 6*a* contracts to absorb the impact force. When an impact force causing the two gusset plates 11, 11 to be displaced away from each other occurs, the disc spring 12*a* interposed between the end plate 6*e* on the side of the gusset plate 11 to which the bolt 6*a* is fixed and the nut 6*c* contracts to absorb the impact force.

Figure 26A:
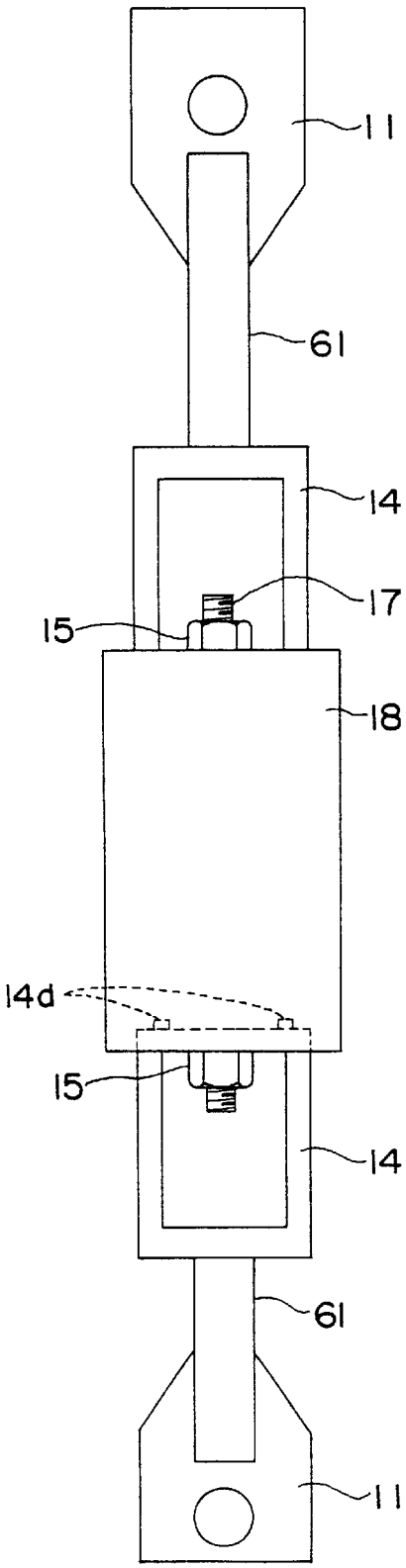
FIG. 26A is an elevational view of an impact absorption member comprising a ring spring.
Figure 26B:
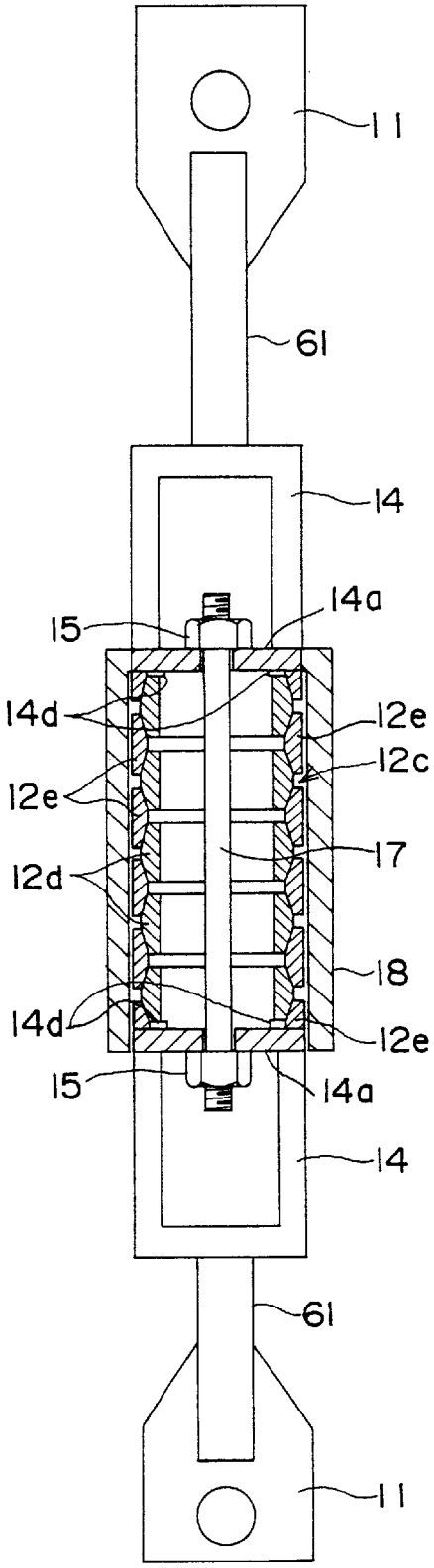
FIG. 26B is a sectional view of the impact absorption member of FIG. 26A.
Figure 27A:
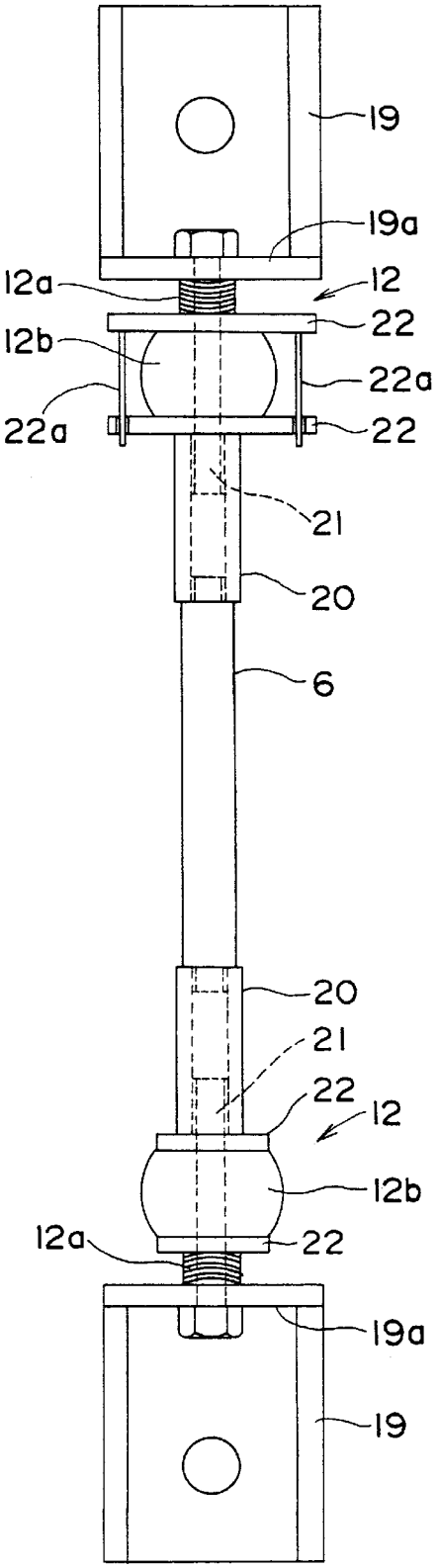
FIG. 27A is an elevational view of a diagonal member provided with impact absorption members at both end portions thereof.
Figure 27B:
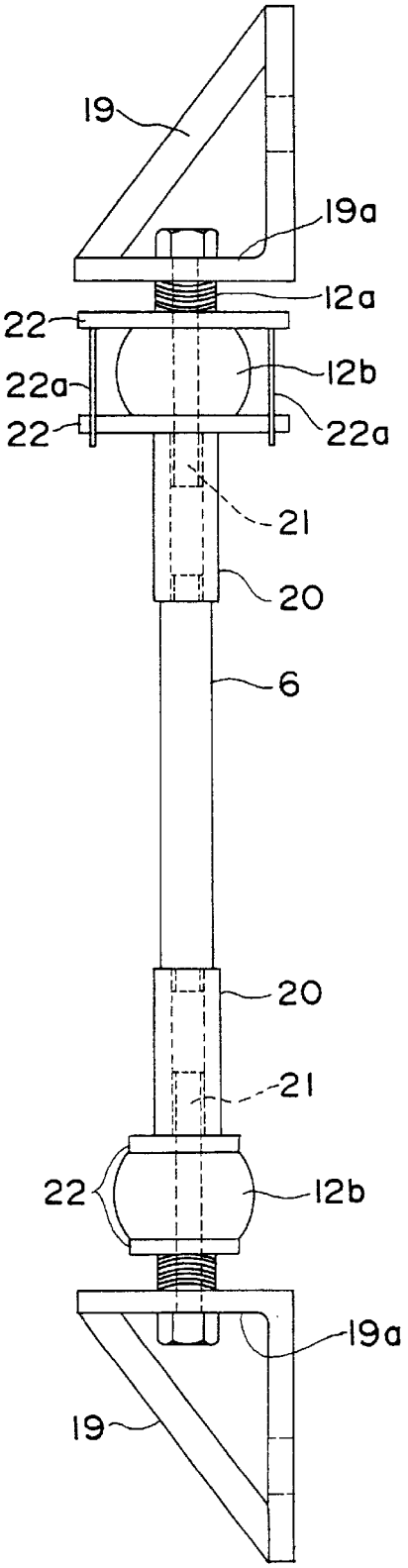
FIG. 27B is a side view of the diagonal member of FIG. 27A.

FIG. 26 shows an example in which a diagonal member 6 is formed of two divisional compression members 61, 61 with fixing members 14, 14 joined to opposed end portions of the compression members 61, 61, a connecting bolt 17 being provided between the two fixing members 14, 14, a ring spring 12*c* as an impact absorption member 12 being provided around the connecting bolt 17.

Out of two end portions of the connecting bolt 17, at least one end portion is joined to the fixing member by a nut 15 so that this end portion can be moved relatively and freely in the axial direction with respect to the relative fixing member 11 just as the end portion of the bolt 13 shown in FIG. 21. The ring spring 12*c* is provided therearound with a cylinder 18 for restricting the bulging thereof. The cylinder 18 is joined to one fixing member 14, and adapted to be moved relatively with respect to the other fixing member 14 in accordance with the expansion and contraction of the ring spring 12*c*.

The surfaces, which are on the side of the ring spring 12*c*, of plates 14*a* of the fixing members 14 are provided with projections 14*d* with inner circumferential sides of which outer rings 12*e* positioned on both end portions of the ring spring 12*c* are engaged. Since the ring spring 12*c* is engaged at both end portions thereof with the projections 14*d*, a movement of the ring spring in the radial direction of the connecting bolt 17 is restricted.

The ring spring 12*c* comprises inner and outer rings 12*d*, 12*e* of different diameters laminated on each other in an axially overlapping manner, and adjacent inner and outer rings 12*d*, 12*e* are engaged with each other at their contact surfaces inclined with respect to an axial plane with clearances secured between the inner rings 12*d*, 12*d* and outer rings 12*e*, 12*e*. A frictional force occurring between the contact surfaces of the inner and outer rings 12*d*, 12*e* normally bear a compressive force, and, at such a time, the inner rings 12*d* and outer rings 12*e* contract and expand respectively in the circumferential direction.

When the ring spring 12*c* bears a compressive force which the diagonal member 6 bears, the inner and outer rings 12*d*, 12*e* are put in an equilibrium state with predetermined levels of contraction and expansion occurring therein. Out of this equilibrium state, the ring spring 12*c* as a whole can further bear the compressive force and axially contract until the clearances between adjacent inner rings 12*d*, 12*d* and between adjacent outer rings 12*e*, 12*e* have been lost, and bear a tensile force and axially expand until the contact surfaces of the inner and outer rings 12*d*, 12*e* have left each other. Namely, the ring spring isolates the axial impact force from an instant at which it fully contracts to an instant at which it fully expands.

When the load is removed after the ring spring 12*c* bore a compressive force until the ring spring as a whole fully contracted, the load only decreases with a predetermined level of strain left in the inner and outer rings 12*d*, 12*e*, and the inner and outer rings 12*d*, 12*e* are thereafter restored to their original shapes. Since a hysteresis curve of the ring spring draws a loop, the ring spring has also the function of absorbing vibration energy when an impact is exerted thereon, and damping the impact force.

FIG. 27 shows an example provided with brackets 19 to which both end portions of a diagonal member 6 are joined, or disc springs 12*a* and rubber members 12*b* as impact absorption members 12 between gusset plates 11 and end portions of the diagonal member 6. In this example, threads are provided on both end portions of the diagonal member 6, on which threads female threads of sleeves 20 are screwed, and bolts 21 passing through plates 19*a* of the brackets 19 are passed through the disc springs 12*a* and rubber members 12*b* and inserted into the sleeves 20 so that the bolts 21 can be moved relatively and freely in the axial direction thereof. The bolts 21 are not screwed into the sleeves 20, and such a length of the portions of the bolts 21 which are inserted into the sleeves 20 that is large enough to prevent the effect of a tensile force from causing the bolts 21 to come off from the sleeves 20 is secured.

Both ends of the rubber members 12*b* are held between plates 22, 22, and both ends of the disc springs 12*a* between the relative plates 22 and the plates 19*a* mentioned above. Referring to the drawing, guide rods 22*a* for preventing the distortion of the two plates 22, 22 while permitting relative movements thereof are provided between the plates 22, 22 which hold therebetween one rubber member 12*b* out of the rubber members 12*b*, 12*b* positioned on both sides of the diagonal member 6.

Figure 28:
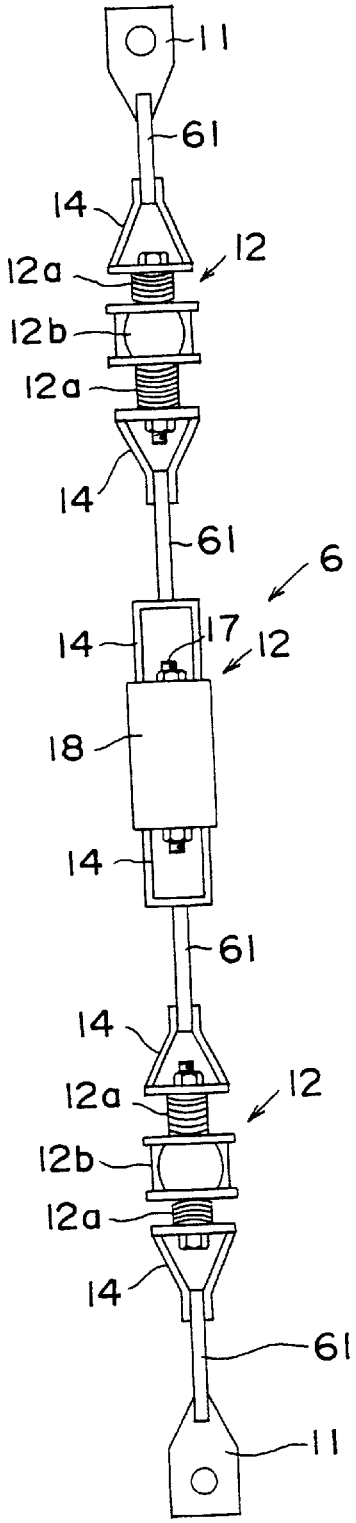
FIG. 28 is an elevational view of a combination of what are shown in FIGS. 24 and 26.

FIG. 28 shows an example in which the impact absorption members 12 shown in FIGS. 24 and 26 are combined with each other and arranged in series.

In the inventions defined in claims 1 and 2, the vibrating units are formed of suspension members constituting tensile force bearing members, and frames and bases to which both end portions of the suspension members are connected, adjacent vibrating units being combined with each other by diagonal members which constitute compressive force bearing members to support the inner circumferential side vibrating units on the outer circumferential side vibrating units. Since the compressive force bearing members are formed of wire rods, hollow spaces allowing the displacement of the bases occur therearound when the directions of the adjacent vibrating units are regulated, whereby the bases of the vibrating units can be relatively displaced with respect to the frames even when the shape in plan and sizes in plan of adjacent vibrating units are identical.

Both the frames and bases may be circular. When the portions to which the suspension members are joined are formed so as to project around the frames and bases, the relative displacement of the bases and frames can be secured irrespective of the shape in plan of the frames and bases since the frames and bases are virtually polygonal concerning a diagonal member installing operation.

In the invention defined in claim 2, the frames and bases are formed to a polygonal shape in plan, and adjacent vibrating units are arranged so as not to overlap each other in plan with diagonal members provided between corner portions of the frames and those of the bases. Therefore, even when the frames and bases have the same shape and same sizes, hollow spaces in which the bases of the inner circumferential side vibrating units can be displaced with respect to those of the outer circumferential side vibrating units can be formed in regions other than the positions in which the diagonal members are provided, without projecting the suspension member-joining portions outward from the frames and bases.

Consequently, it becomes unnecessary to increase the scale of the vibrating units from the inner circumferential side vibrating units to the outer circumferential side vibrating units, and this enables the area occupied by the seismic isolator comprising vibrating units arranged in a multiplex manner to be reduced.

Since the compressive force bearing members are diagonal members, the construction of the vibrating units is simplified as compared with that of vibrating units using face bars as such members, and the weight of the vibrating units decreases, so that the reduction of the manufacturing cost and the improvement of the efficiency of the assembling work can be attained.

Moreover, since the compressive force bearing members comprise wire rods, the constituent members as a whole of the vibrating units can be seen through, and this enables the maintenance and management of the vibrating units to be carried out easily.

When springs for preventing the relative vertical displacement between the upper and lower structures are provided on the joint portions of the suspension members and frames and bases, or when dampers for suppressing the vertical vibrations of these structures are provided on the same portions, the installation, removal, maintenance and management of the spring and dampers can be carried out easily since the suspension members are not hidden behind the compressive force bearing members.

In the invention defined in claim 3, impact absorption members expansible and contractible in the axial direction of the diagonal members and having a compressive force bearing capability and an original form restoring force are provided on end portions or intermediate portions of the diagonal members, so that an impact force absorbing function can be added to the seismic isolator.

Since the transmission of an impact force to the frames to which the upper end portions of the diagonal members are joined is prevented or lessened owing to the expansion and contraction of the impact absorption members, the performance of the seismic isolator and the upper structure which the seismic isolator supports can be kept sound.

What is claimed is:

1. A seismic isolator formed between upper and lower structures which are structurally insulated from each other, comprising a core member joined to said upper structure but insulated from said lower structure, and adapted to bear a vertical load of said upper structure as a compressive force, and a plurality of vibrating units arranged in a multiplex manner around an outer circumference of said core member, said vibrating units being formed of frames positioned on a relatively upper side, bases positioned below said frames, and suspension members provided between said frames and said bases, supporting said bases in a suspended state, and adapted to bear the vertical load of said upper structure as a tensile force, diagonal members adapted to bear the vertical load of said upper structure as a compressive force and having the inner circumferential side vibrating units supported on the outer circumferential side vibrating units being provided between said frames of said vibrating units positioned on the relatively inner circumferential side and said bases of said vibrating units positioned on the outer circumferential side, a lower end portion of said core member being joined to said bases of said vibrating units positioned on the innermost circumferential side, said vibrating units positioned on the outermost circumferential side being supported on said lower structure directly or indirectly via said diagonal members extended between the relative frames and said lower structure.

2. A seismic isolator according to claim 1, wherein said frames and said bases are polygonal in plan, adjacent vibrating units being arranged so as not to overlap each other in plan, said diagonal members being provided so as to extend between corner portions of said frames and those of said bases.

3. A seismic isolator according to claim 2, wherein impact absorption members expansible and contractible in the axial direction of said diagonal members and having a compressive force bearing capability and an original shape restoring force are provided on end portions or at intermediate portions of said diagonal members.

* * * * *

UNITED STATES PATENT AND TRADEMARK OFFICE

CERTIFICATE OF CORRECTION

PATENT NO. : 6,226,935 B1
DATED : May 8, 2001
INVENTOR(S) : Michio Kuramochi et al.

It is certified that error appears in the above-identified patent and that said Letters Patent is hereby corrected as shown below:

Column 1,
Line 15, delete "of f" and insert -- off --.

Column 4,
Line 32, "When" should begin a new paragraph.

Column 7,
Line 19, delete "a re" and insert -- are --.

Column 12,
Lines 10, 13, 14 and 17, delete "51j, 51j" and insert -- 51k, 51k --.

Signed and Sealed this

Seventh Day of May, 2002

*Attest:*

*Attesting Officer*

JAMES E. ROGAN
*Director of the United States Patent and Trademark Office*